US007845432B2

(12) United States Patent
Salins et al.

(10) Patent No.: US 7,845,432 B2
(45) Date of Patent: Dec. 7, 2010

(54) MICROTUNNELLING SYSTEM AND APPARATUS

(75) Inventors: Andis Salins, Footscray (AU); Stuart Harrison, Dandenong South (AU)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 12/335,193

(22) Filed: Dec. 15, 2008

(65) Prior Publication Data

US 2009/0152008 A1 Jun. 18, 2009

Related U.S. Application Data

(63) Continuation of application No. PCT/AU2006/001122, filed on Aug. 8, 2006.

(30) Foreign Application Priority Data

Jun. 16, 2006 (AU) ..... 2006903269

(51) Int. Cl.
*E21B 17/18* (2006.01)
*E21B 21/00* (2006.01)

(52) U.S. Cl. ..... 175/215; 175/62

(58) Field of Classification Search ..... 175/45, 175/62, 215; 299/1.4, 1.8; 405/138, 145, 405/184.5, 183.5, 174; 285/50, 54
See application file for complete search history.

(56) References Cited

U.S. PATENT DOCUMENTS

| | | | |
|---|---|---|---|
| 134,506 | A | 1/1873 | Ball |
| 825,857 | A | 7/1906 | Moran et al. |
| 858,525 | A | 7/1907 | Mettler |
| 1,026,412 | A | 5/1912 | Stone |
| 1,772,491 | A | 8/1930 | Koppl |

(Continued)

FOREIGN PATENT DOCUMENTS

| | | |
|---|---|---|
| AU | B-80723/87 | 4/1988 |

(Continued)

OTHER PUBLICATIONS

Klein et al. "New Developments in Microtunneling." Paper presented at 36th Engineering Geology and Geotechnical Engineering Symposium, University of Nevada, Las Vegas. Mar. 28-30, 2001.

(Continued)

*Primary Examiner*—Jennifer H Gay
*Assistant Examiner*—Cathleen R Hutchins
(74) *Attorney, Agent, or Firm*—Merchant & Gould P.C.

(57) ABSTRACT

A microtunnelling apparatus and system that includes an external drive system having rotational and linear thrust drive means, a drill head section having drill rotor and drill rod and connecting to intermediate drill rods allowing extension of the boring hole created by the drill head section driven by the drive system. The drill head includes a modular construction having a plurality of circular disc like elements, a bearing module, a steering module, a spacer module, and a mounting module, for axial alignment and abutment and mounting within a cylindrical steering shell. Directional steering of the drill head includes a plurality of substantially radially extending channels in steering module, each with an hydraulically movable protuberance movable by control means to redirect the outer steering casing and thereby redirect the drill head section mounted on the distal end of the drill rods.

29 Claims, 21 Drawing Sheets

U.S. PATENT DOCUMENTS 2,317,729 A 4/1943 Bruno
2,494,803 A 1/1950 Frost et al.
2,745,650 A 5/1956 Smith
2,786,652 A 3/1957 Wells
2,850,264 A 9/1958 Grable
3,145,789 A 8/1964 Lawry
3,208,539 A 9/1965 Henderson
3,297,100 A 1/1967 Crews
3,321,248 A 5/1967 Williamson et al.
3,354,950 A 11/1967 Hyde
3,419,092 A 12/1968 Elenburg
3,459,442 A 8/1969 Yarmett et al.
3,482,103 A 12/1969 Martinsen
3,498,673 A 3/1970 Ledray et al.
3,508,622 A 4/1970 Benetti et al.
3,554,301 A 1/1971 Adkins et al.
3,635,108 A 1/1972 Prince
3,707,330 A 12/1972 Pine
3,778,107 A 12/1973 Haspert
3,799,612 A 3/1974 Norton et al.
3,799,615 A 3/1974 Taylor et al.
3,821,993 A 7/1974 Kniff et al.
3,837,413 A 9/1974 Dunn
3,857,449 A * 12/1974 Kimura ..... 175/26
3,938,597 A 2/1976 Richmond et al.
3,939,926 A 2/1976 Barnes et al.
4,013,134 A 3/1977 Richmond et al.
4,023,861 A 5/1977 Schnell
4,026,371 A 5/1977 Takada et al.
4,027,210 A 5/1977 Weber
4,059,163 A 11/1977 Stedman
4,076,084 A 2/1978 Tighe
4,099,585 A 7/1978 Emmerich
4,122,683 A 10/1978 Follert et al.
4,149,739 A 4/1979 Morris
4,186,808 A 2/1980 Cox
4,221,503 A 9/1980 Cherrington
4,273,468 A 6/1981 Cyfka
4,311,344 A 1/1982 Akesaka
4,378,057 A 3/1983 O'Connell
4,392,744 A 7/1983 Tatsuhama et al.
4,394,881 A 7/1983 Shirley
4,403,664 A 9/1983 Sullinger
4,406,498 A 9/1983 Akesaka
4,494,617 A 1/1985 Snyder
4,506,745 A 3/1985 Bjor
4,553,612 A 11/1985 Durham
4,556,256 A 12/1985 Follert et al.
4,576,515 A 3/1986 Morimoto et al.
4,624,605 A 11/1986 Akesaka
4,630,869 A 12/1986 Akesaka et al.
4,655,493 A 4/1987 Sumi
4,683,944 A 8/1987 Curlett
4,692,062 A * 9/1987 Akesaka ..... 405/141
4,698,491 A 10/1987 Lysen
4,784,230 A 11/1988 Cherrington et al.
4,790,395 A 12/1988 Gack et al.
4,828,050 A 5/1989 Hashimoto
4,834,193 A 5/1989 Leitko, Jr. et al.
4,836,305 A 6/1989 Curlett
4,868,648 A 9/1989 Nobunaga
4,875,292 A 10/1989 Gibson
4,886,394 A 12/1989 Akesaka
4,961,469 A 10/1990 Larsson et al.
5,046,903 A 9/1991 Nagayoshi et al.
5,076,729 A 12/1991 Grotenhofer
5,078,545 A 1/1992 Akesaka
5,099,927 A 3/1992 Gibson et al.
5,102,201 A 4/1992 Akesaka
5,123,708 A 6/1992 Akesaka
5,133,418 A 7/1992 Gibson et al.
5,156,490 A 10/1992 Terasawa
5,163,520 A 11/1992 Gibson et al.
5,236,284 A 8/1993 Ilomaki
5,265,682 A 11/1993 Russell et al.
5,296,915 A 3/1994 Akesaka
5,316,092 A 5/1994 Ilomäki
5,361,854 A 11/1994 Tull et al.
5,366,031 A 11/1994 Rickards
5,393,172 A 2/1995 Akesaka
5,423,575 A 6/1995 Parks
5,425,429 A 6/1995 Thompson
5,437,500 A 8/1995 Lehmann et al.
5,470,132 A 11/1995 Cartwright
5,484,232 A 1/1996 Hayashi et al.
5,485,889 A 1/1996 Gray
5,501,548 A 3/1996 Hayashi et al.
5,527,135 A 6/1996 Hayashi et al.
5,529,437 A 6/1996 Filipowski et al.
5,632,575 A 5/1997 Lorenzen et al.
5,682,953 A 11/1997 Buysse
5,682,956 A 11/1997 Deken et al.
5,687,807 A 11/1997 Woods et al.
5,846,027 A 12/1998 Fujii
5,860,232 A 1/1999 Nathenson et al.
5,887,667 A 3/1999 Van Zante et al.
5,890,771 A 4/1999 Cass
5,938,288 A 8/1999 Saint-Pierre et al.
6,017,095 A 1/2000 DiMillo
6,050,350 A 4/2000 Morris et al.
6,158,529 A 12/2000 Dorel
6,332,652 B1 12/2001 Nakakuro
6,342,946 B1 1/2002 Holstein
6,454,025 B1 9/2002 Runquist et al.
6,470,605 B1 10/2002 Gilman et al.
6,527,054 B1 3/2003 Fincher et al.
6,533,052 B2 3/2003 Wentworth et al.
6,585,062 B2 7/2003 Rozendaal et al.
6,659,202 B2 12/2003 Runquist et al.
6,668,946 B2 * 12/2003 Rankin et al. ..... 175/62
RE38,418 E 2/2004 Deken et al.
6,712,556 B2 * 3/2004 Penza ..... 405/183.5
7,055,627 B2 6/2006 Fontana et al.
7,070,359 B2 7/2006 Richardson et al.
7,093,671 B2 8/2006 Puttmann
7,111,695 B2 9/2006 Puttmann
7,152,702 B1 12/2006 Bhome et al.
7,216,724 B2 5/2007 Self et al.
7,243,737 B2 7/2007 Michael
7,367,412 B2 5/2008 Barbera et al.
7,389,831 B2 6/2008 Mullins et al.
2004/0060740 A1 4/2004 Puttmann
2004/0108139 A1 * 6/2004 Davies ..... 175/26
2005/0103527 A1 * 5/2005 Church et al. ..... 175/62
2005/0257959 A1 11/2005 Richardson et al.
2006/0060384 A1 3/2006 Michael
2006/0279078 A1 * 12/2006 Johnson et al. ..... 285/27
2007/0089906 A1 * 4/2007 Davies ..... 175/26
2007/0143773 A1 6/2007 Park et al.

FOREIGN PATENT DOCUMENTS

AU A-12360/88 9/1988
DE 32 03 924 A 1 8/1983
DE 40 18 842 C 1 7/1991
DE 101 32 972 C 1 10/2002
EP 1 316 670 B1 6/2003
JP 53-126713 11/1978
JP 61-40988 2/1986
JP 63-190394 12/1988
JP 02-016287 1/1990
JP 03-033393 2/1991
JP 03-047396 2/1991
JP 04-353189 12/1992

| | | | |
|---|---|---|---|
| JP | 05-202688 | | 8/1993 |
| JP | 6-40094 | | 5/1994 |
| JP | 07-293191 | | 11/1995 |
| JP | 2000-328876 | | 11/2000 |
| JP | 2005213848 | A | 8/2005 |
| SU | 1579976 | A1 | 7/1990 |
| WO | WO 88/02435 | | 4/1988 |
| WO | WO 94/20726 | | 9/1994 |
| WO | WO 02/44508 | A2 | 6/2002 |
| WO | WO 02/44511 | A1 | 6/2002 |
| WO | WO 02/064939 | A1 | 8/2002 |
| WO | WO 2006/119797 | A1 | 11/2006 |
| WO | WO 2007/124789 | A1 | 11/2007 |
| WO | WO 2007/143773 | A1 | 12/2007 |

OTHER PUBLICATIONS

Nagashima et al. "'Trunk Mole': Long Distance Micro-Tunneling Method for Gas Transmission Pipelines." 1995 International Gas Research Conference, Pipeline Engineering and Development Center, Tokyo Gas Co., Ltd.

International Preliminary Report on Patentability (PCT/AU2006/001122).

Written Opinion of the International Searching Authority (PCT/AU2006/001122).

Vermeer Hdd Tooling & Accessories catalog, vol. 6, 2005.

USPTO Office Action, dated Sep. 11, 2009, issued for U.S. Appl. No. 12/335,232, in the name of Salins et al.

"EPB Machine Part No. A10500F" Product information sheet. Akkerman Inc. www.akkerman.com.

"Thrust Frame—Latching—308A" Product information sheet. Akkerman Inc. www.akkerman.com.

"Thrust Frame—4812A" Product information sheet. Akkerman Inc. www.akkerman.com.

"Upsizing Tool—Powered Cutter Head" Product information sheet. Akkerman Inc. www.akkerman.com.

"Earth Pressure Balance Machines (EPBM)" Product information. Akkerman Inc. Downloaded Jun. 2, 2009. (http://www.akkerman.com/products-epb.php).

"Microtunneling" Product information. Akkerman Inc. Downloaded Jun. 2, 2009. (http://www.akkerman.com/products-microtunneling.php).

"Guided Boring Machines (GBM)" Product information. Akkerman Inc. Downloaded Jun. 2, 2009. (http://www.akkerman.com/products-gbm.php).

"Conventional Tunneling Boring Machine (TBM)" Product information. Akkerman Inc. Downloaded Jun. 2, 2009. (http://www.akkerman.com/products-conventional-tbm.php).

"Guided Boring Machine" Technical Manual. Akkerman Inc. Downloaded Jun. 2, 2009. (http://www.akkerman.com/products-products-manuals.php).

* cited by examiner

COVER REMOVED FOR CLARITY

MICROTUNNELLING SYSTEM AND APPARATUS

This application is Continuation of PCT/AU2006/001122, filed 8 Aug. 2006, which claims benefit of Serial No. 2006903269, filed 16 Jun. 2006 in Australia and which applications are incorporated herein by reference. To the extent appropriate, a claim of priority is made to each of the above disclosed applications.

FIELD OF THE INVENTION

This invention relates to underground boring and more particularly to an improved microtunnelling system and apparatus.

In this document "microtunnelling" is considered to comprise trenchless horizontal boring of a bore of the order of 600 millimetres and less.

BACKGROUND OF THE INVENTION

Modern installation techniques provide for underground installation of services required for community infrastructure. Sewage, water, electricity, gas and telecommunication services are increasingly being placed underground for improved safety and to create more visually pleasing surroundings that are not cluttered with open services.

Currently, the most utilised method for underground works is to excavate an open cut trench. This is where a trench is cut from the top surface and after insertion of piping or optical cable is then back-filled. This method is reasonably practical in areas of new construction where the lack of buildings, roads and infrastructure does not provide an obstacle to this method. However, in areas supporting existing construction, an open cut trench provides obvious disadvantages, major disruptions to roadways and high possibility of destruction of existing infrastructure (i.e. previously buried utilities). Also, when an open cut trench is completed and backfilled the resultant shift in the ground structure rarely results in a satisfactory end result as the trench site often sinks. Open trenches are also unsafe to pedestrians and workers.

Another concept employed for underground works is that of boring a horizontal underground hole. Several methods employ this philosophy as it generally overcomes the issues of disruption to roads and infrastructure as described for open cut trenches however even these methods have their inherent problems.

One method is horizontal directional drilling (HDD). In this method a boring device is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the surface. A reamer is then attached to the drill string, which is pulled back through the borehole, thus reaming out the borehole to a larger diameter. It is common to attach a utility line or other conduit to the reaming tool so that it is dragged through the borehole along with the reamer. A major problem with this method is that the steering mechanism is extremely inaccurate and unsuitable for applications on grade. The stop and start action utilised by the operator results in a bore that is not completely straight. The operator has no way of knowing exactly where the hole goes which can result in damage to existing utilities. This could pose a safety threat particularly if the services in the area are of a volatile nature.

Another method is the pilot displacement method. This method uses a drill string pushed into the ground and rotated by a jacking frame. A theodolite is focused along the drill string as a point of reference to keep the line on grade. This system is not accurately steered. The slant on the nose is pointed in the direction of intended steering. The position of the head is monitored through a total station with a grade and line set and measuring this point against a target mounted in the head of the pilot string. If the ground conditions are homogenous and the conditions absolutely perfect, it will produce a satisfactory bore. Unfortunately this is rarely the case. Ground conditions are generally variable the pilot tube will tend to steer towards whichever ground offers the least resistance irrespective of the direction in which you are the steering. As the drill strings are generally short, the time to drill is often slow with repeated connections making the process tedious. Once the bore reaches the reception shaft augers are attached and pulled back along the bore to displace the spoil into the reception shaft. This then has to be manually removed which is time consuming.

Slurry style microtunnelling utilises slurry reticulation to transport spoil removal throughout the installation process. Two lines are fed via a starting shaft along the bore. The pipes are jacked via a hydraulic jacking frame into the hole. Water is forced along the feed pipe to the cutting face where the spoil slurry of rock and mud is forced back along the return pipe. Whilst enjoying a good degree of accuracy, this system requires a structural shaft that needs a massive amount of force to push the pipes. This results in a large, expensive jacking shaft pit that is time consuming to build. The sheer weight and size of the components make them slow to connect and cumbersome to use, If the unit becomes damaged or stuck in the bore, the only method available to retrieve the unit would be to dig down onto the drill head location.

In one form of boring machine shown by US Patent Application No. US2004/0108139 to Davies and corresponding to Australian Patent 2003262292 there is disclosed a micro tunnelling machine having a tunnelling head with a boring bit which is forced in a horizontal direction by an hydraulic thruster. The direction of the head is laser guided. The beam strikes a target in the head and a camera relays an image of the target to an operator located at the tunnel entrance. The operator adjusts the direction by admitting water and draining water from a pair of rams inside the head, which move the boring bit up and down or left and right. A semi automatic version is disclosed in which a microprocessor adjusts the direction until the operator assumes control. In particular the invention is claimed to be a guidance system for the boring head of a micro-tunnelling machine of the type which bores in a selected direction and inclination using laser beam guidance having the endmost part of the drive to the boring bit adjustable in two directions at 90°, wherein, the endmost part of the drive has a target for the laser beam, means to convey an image of the target and the laser strike position thereon to an operator situated remotely from the boring head and input means for the operator to adjust the direction of the endmost part of the drive.

The major approach of the directional control of the disclosed apparatus of US Patent Application No. US2004/0108139 to Davies is to have the drive shaft connected at its end distal to the cutting edge in a manner that allows the drive shaft to move as required and to allow the cutting element to be redirected to correct position as determined by the laser controlled directional system. However this form of apparatus places all the strain on an elongated movable drive shaft retained by cylinders and therefore readily increases the risk of breakage. There is clearly a need to provide an improved system to decrease chance of breakage of the drill head components.

It can be appreciated that present methods of underground tunnelling are cumbersome, inaccurate; and require repeated halting of boring operations due to waste removal and heating effects. Moreover, there is an inherent delay resulting from replacement of parts of conventional boring systems since it usually requires the boring tool to be recovered from the site and returned to the assembly factory. Recovery in itself can be cumbersome and expensive particularly if a new vertical access hole is required to recover the tool. This could damage the road or services under which the bored tunnel is extending. Further present systems are unable to accurately remain on fixed boring direction, which are often needed when a buried obstruction is detected or changing soil conditions are encountered.

SUMMARY OF THE INVENTION

In accordance with the invention there is provided an apparatus and method for underground boring on grade more particularly to an improved microtunnelling system and apparatus.

In this document "microtunnelling" is considered to comprise trenchless horizontal boring of a bore of the order of 600 millimetres and less. This is particularly relevant to the insurgence of pipes of the order of around 300 millimetres.

The drawbacks of current microtunnelling technology are significant and have been overcome or are at least ameliorated by the current invention including one or more of the following improvements and other improvements as will be understood from the description.

A first fundamental improvement is the use of an external casing with flow channels therein and the drive rod mounted therein and allows for all cabling and hosing to be mounted in an external cavity, which thereby allows for continuous cabling over a plurality of encased intermediate drill rods.

A second fundamental improvement is the incorporation of the driveline within the vacuum chamber. Incorporating the rotation within the vacuum achieves multiple goals. Firstly, the vacuum area can be dramatically increased and so maximize the machines ability to remove spoil and in such increased productivity. Secondly, the rotation component of the drill rod generates heat. The removal of this heat from the laser area is critical to laser accuracy. By combining the rotation into the vacuum area, any heat generated is immediately removed and the laser therefore is unaffected.

A third fundamental improvement is the steering mechanism of the encased drill rod using radially protrusions engaging steering shell to direct the drill head and prevent any undue force on the drill head centrally mounted within the casing.

A fourth fundamental improvement is the modular structure of the drill head by a plurality of disc like modules that can be created by direct external etching, drilling or casting or the like and be combined in cylindrical shells to form a readily assembled drill head.

A fifth fundamental improvement is the modular components of the drive means that allows for differing rotational units to be used with a thrust unit that provides linear pull as well as push capabilities. This allows matching of rotational units to material being bored and size of pipe being inserted and further allows for reverse reaming to a larger diameter after initial bore has been accurately drilled.

BRIEF DESCRIPTION OF THE DRAWINGS

In order that the invention is more readily understood an embodiment will be described by way of illustration only with reference to the drawings wherein.

DETAILED DESCRIPTION OF THE INVENTION

Figure 1:
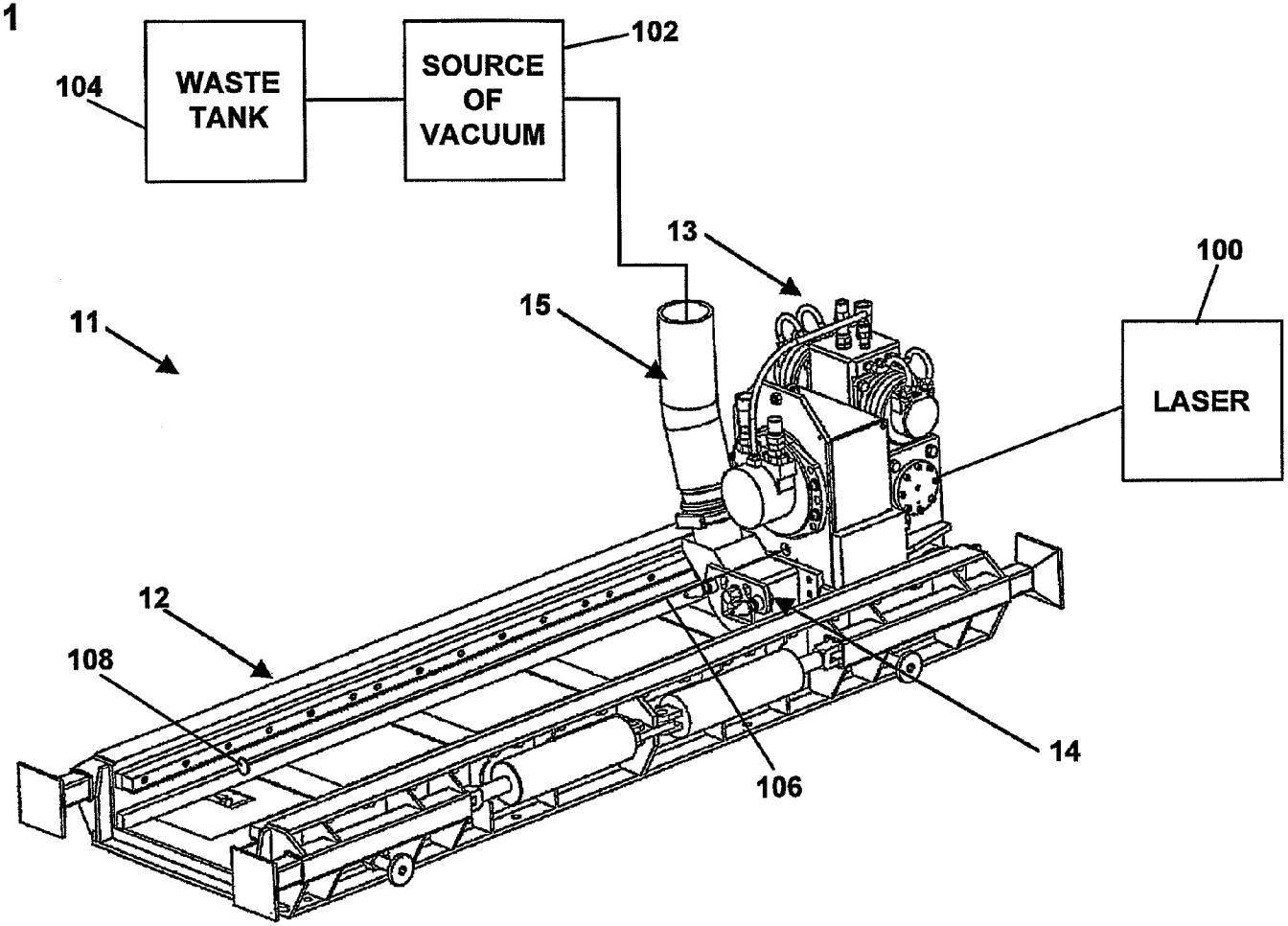
FIG. 1 is a perspective view of a drive means of a microtunnelling system and apparatus in accordance with the invention including a thrust module and rotation module mounted on a rack system and further including a vacuum for assisting return slurry.

Referring to the drawings there is shown a microtunnelling apparatus and system that comprises a drive system (11), a drill head section (20) and intermediate drill rods (41) allowing extension of the boring hole created by the drill head section driven by the drive system.

The drive system (11) as shown in FIG. 1 includes a power source and a track system for allowing limited linear drive of the power source. The track system includes a rack and pinion gearing system (12) to allow maintained linear thrust pressure along the length of the track. The power source includes a hydraulic thrust module (13), which reciprocates a rotation module (14) housed in the thrust box in the launch shaft. The product pipe can be either pushed or pulled into place for pipeline completion.

Figure 14:
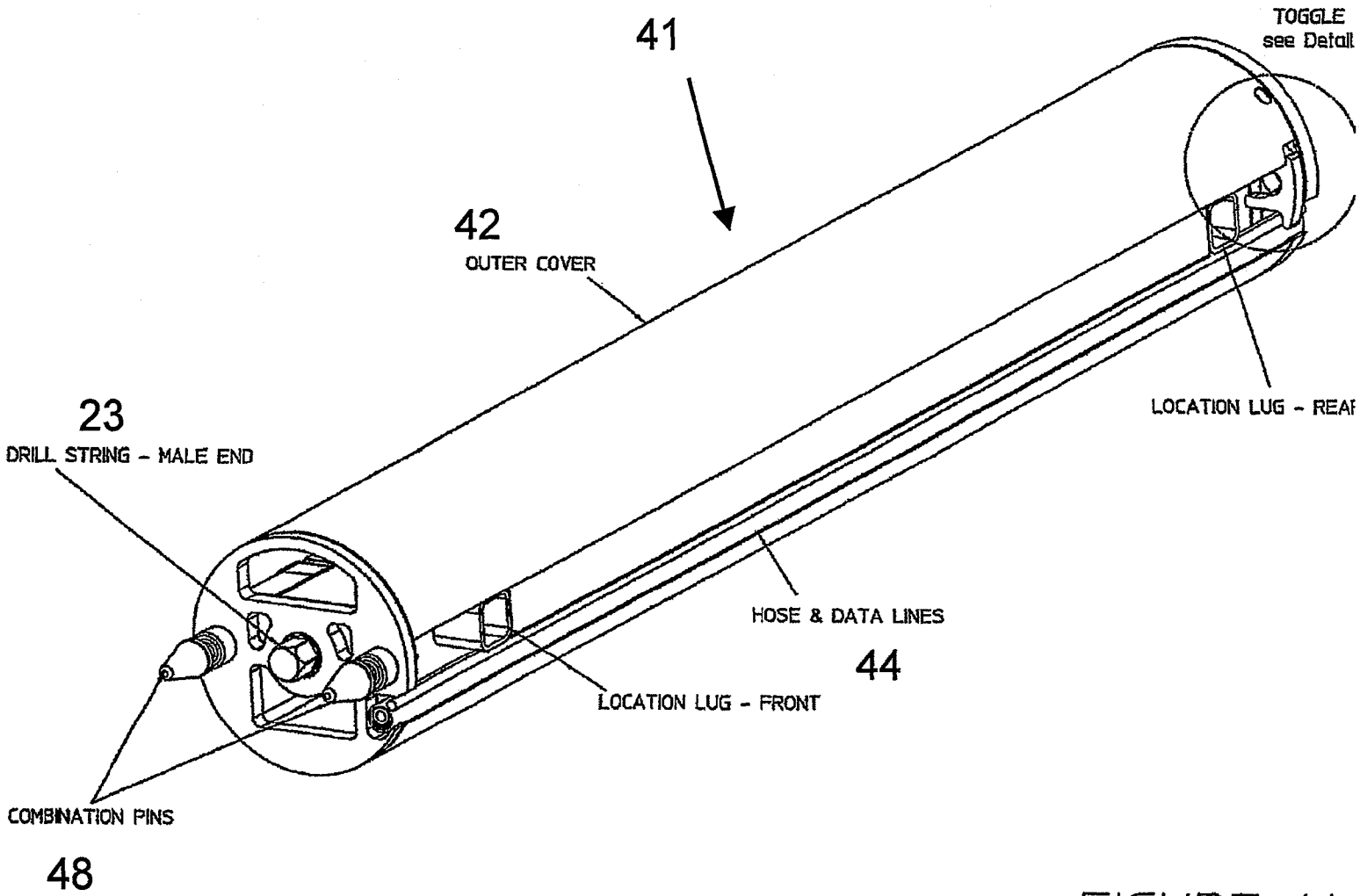
FIG. 14 is a perspective view of a drive rod for extending between the drive means of FIG. 1 and the drill head of FIG. 2
Figure 15:
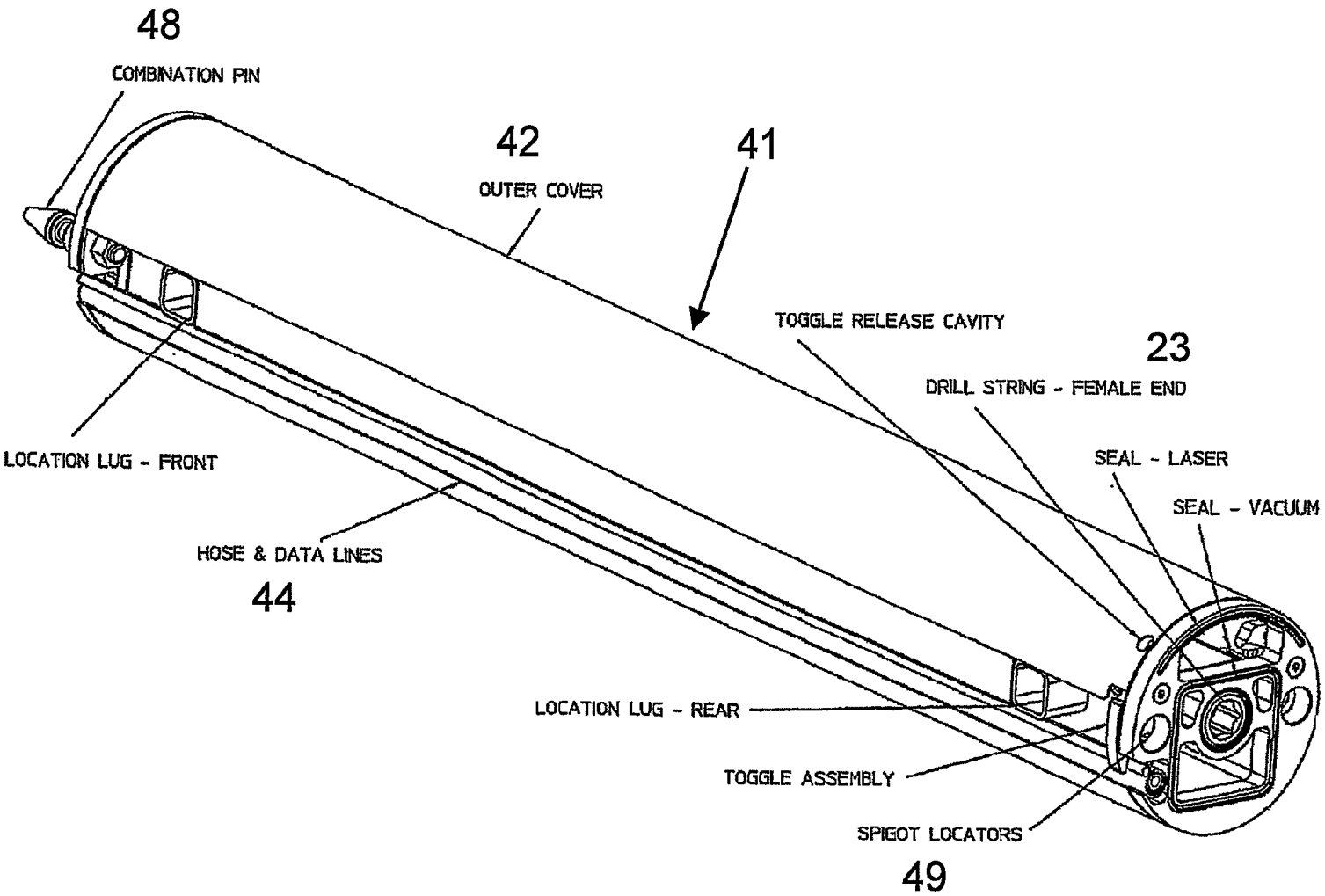
FIG. 15 is a perspective reverse view of the drive rod of FIG. 6.

To the front of the rotation module (14) is attached encased intermediate drill rods (41) such as shown in FIGS. 14 and 15.

Figure 2:
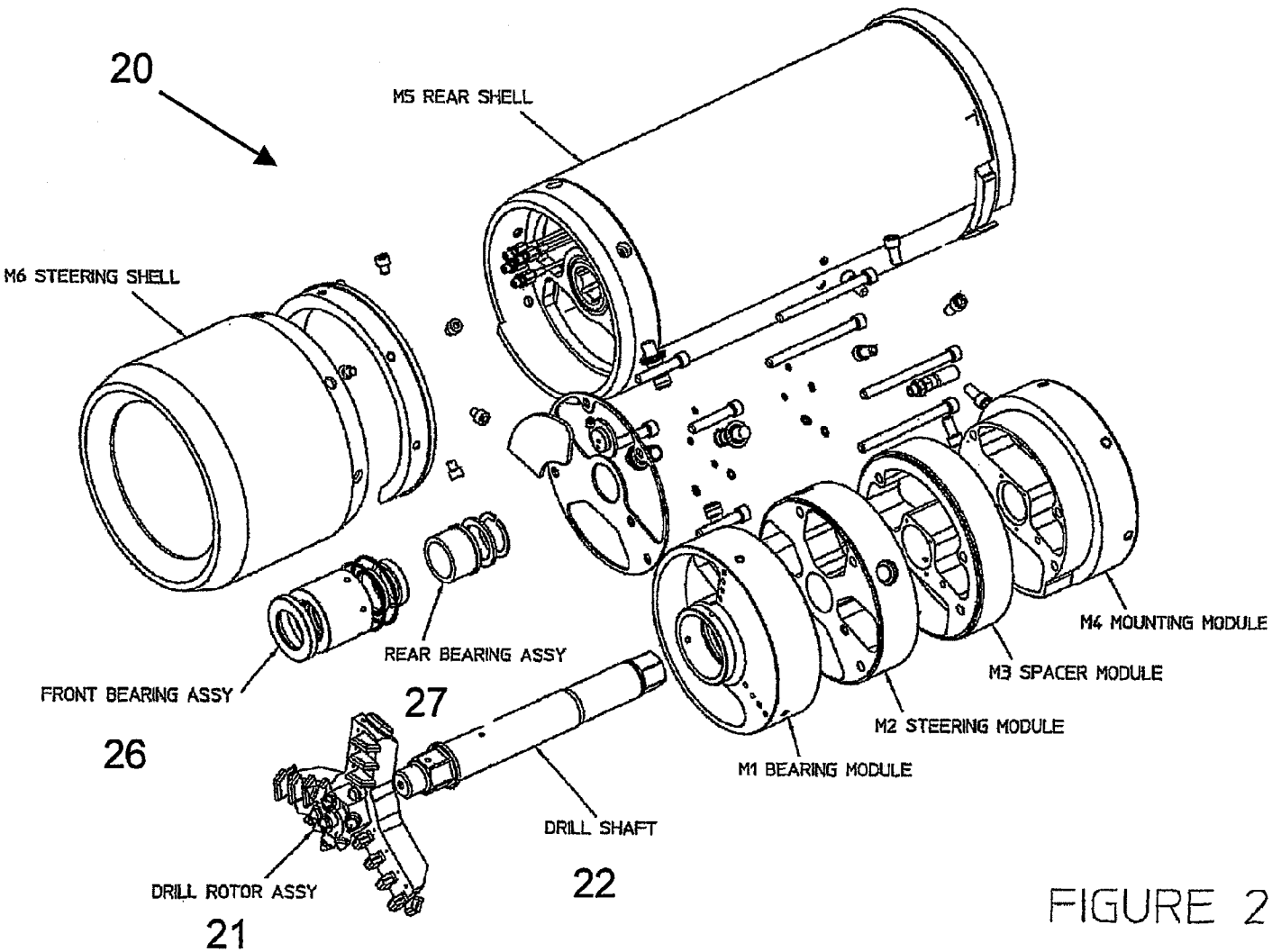
FIG. 2 is a perspective exploded view of a drill head able to be driven by the drive means of FIG. 1 for use in the microtunnelling system and apparatus in accordance with the invention.
Figure 3:
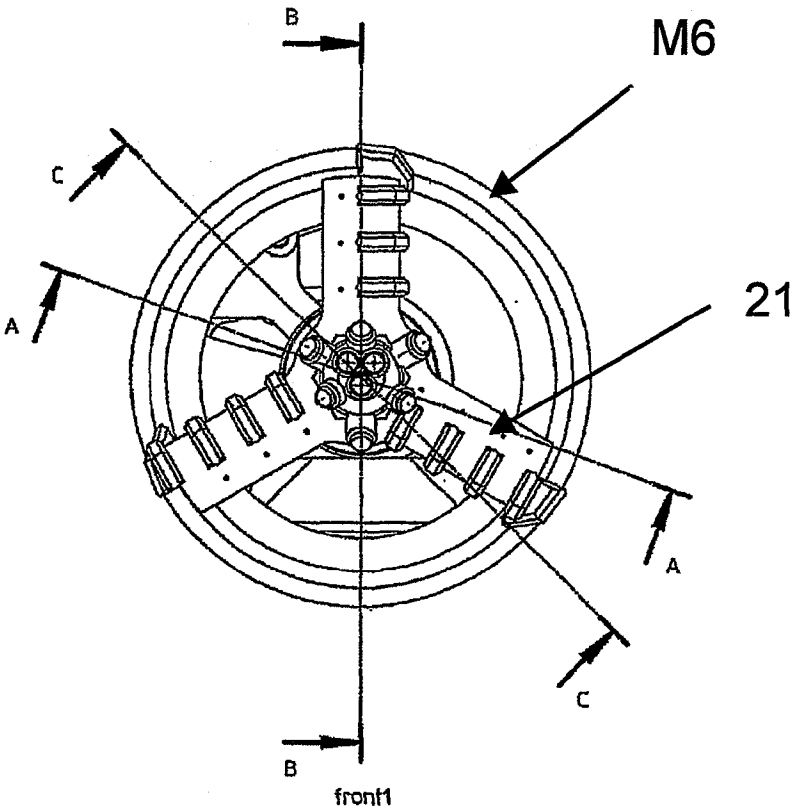
FIG. 3 is a front view of an enclosed drill head with front cutting means able to be driven by the drive means of FIG. 1 for use in the microtunnelling system and apparatus in accordance with the invention.
Figure 4:
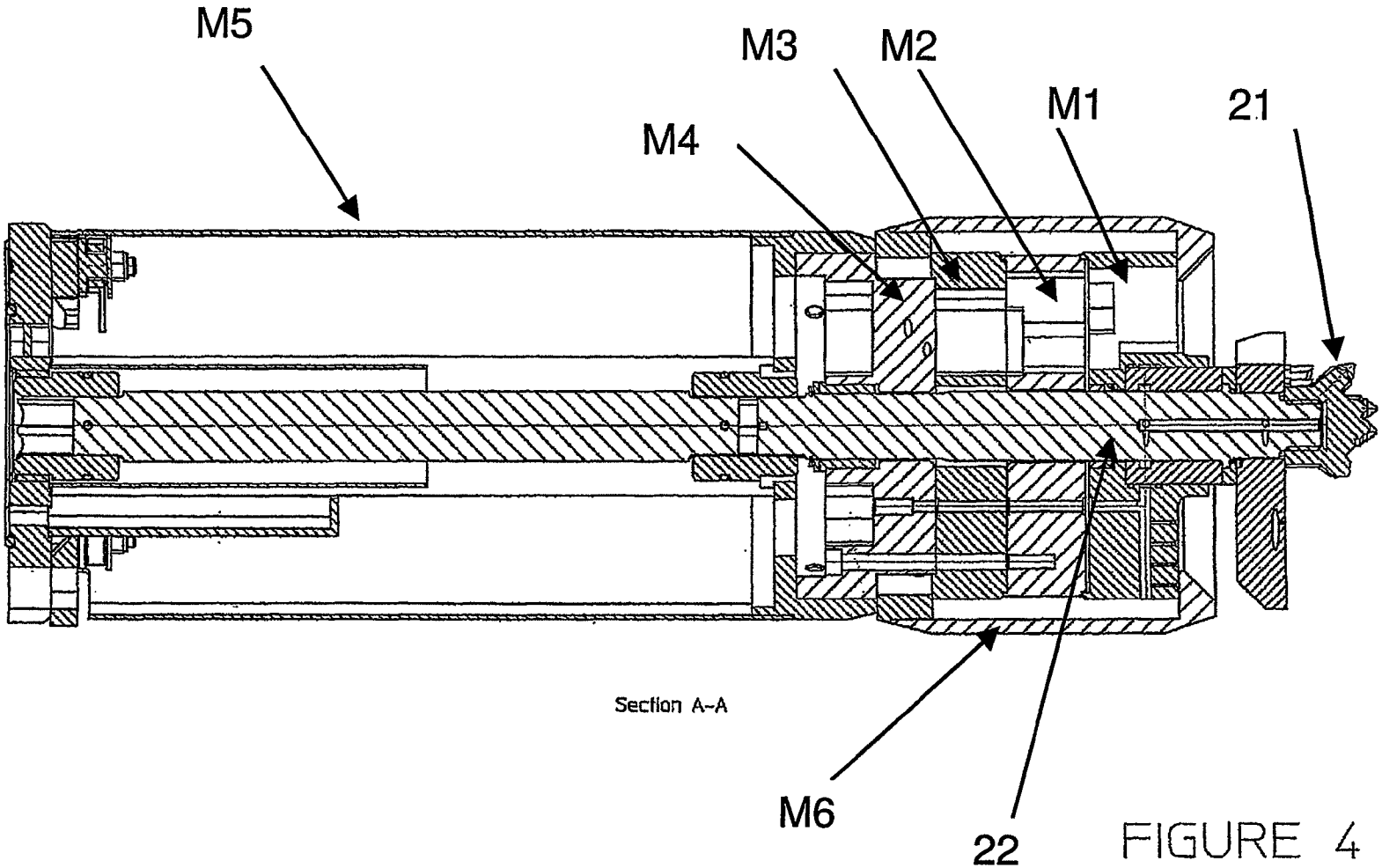
FIG. 4 is a cross sectional view of the enclosed drill head with front cutting means of FIG. 3 through section A-A.
Figure 5:
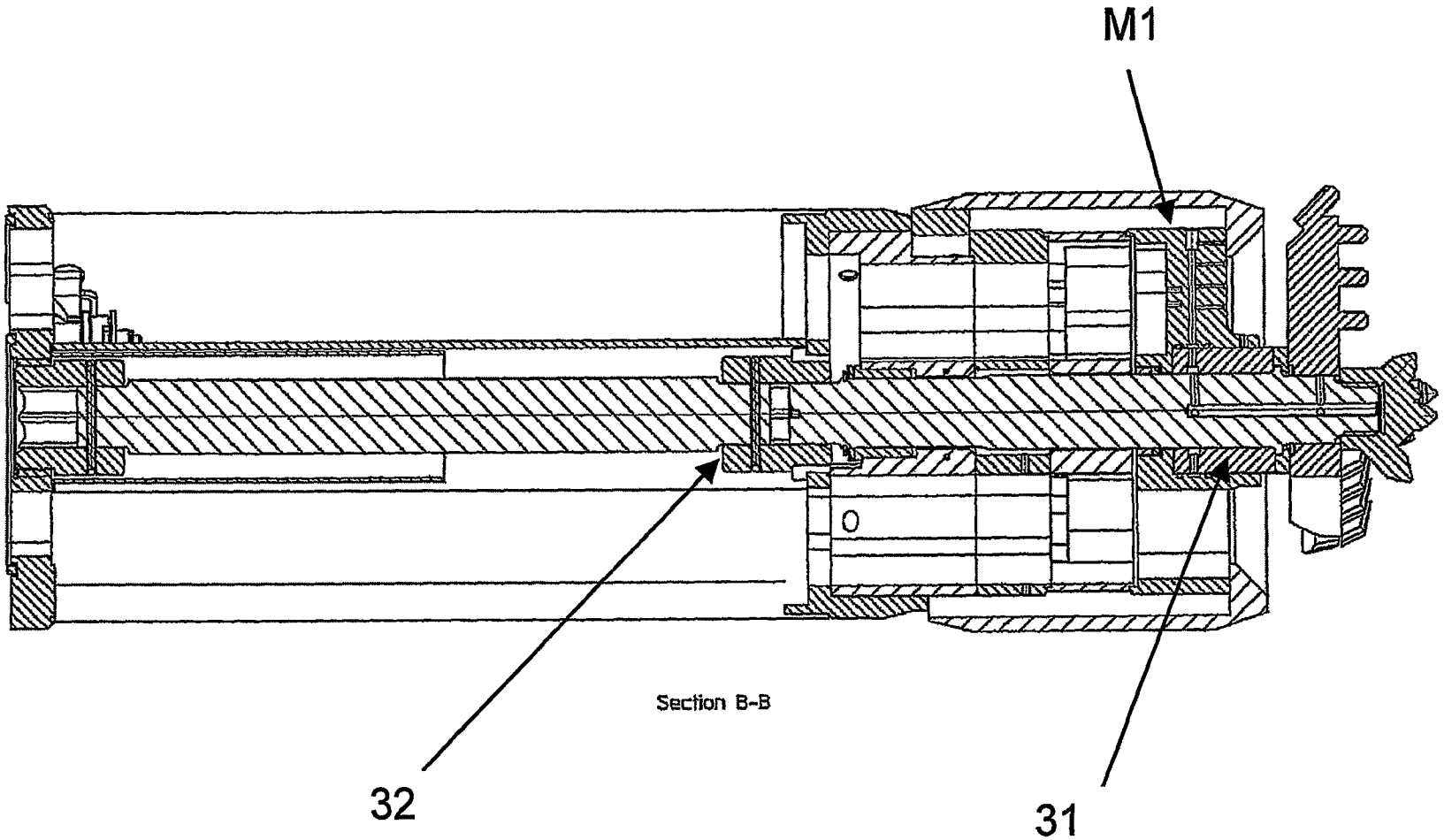
FIG. 5 is a cross sectional view of the enclosed drill head with front cutting means of FIG. 3 through section B-B.
Figure 6:
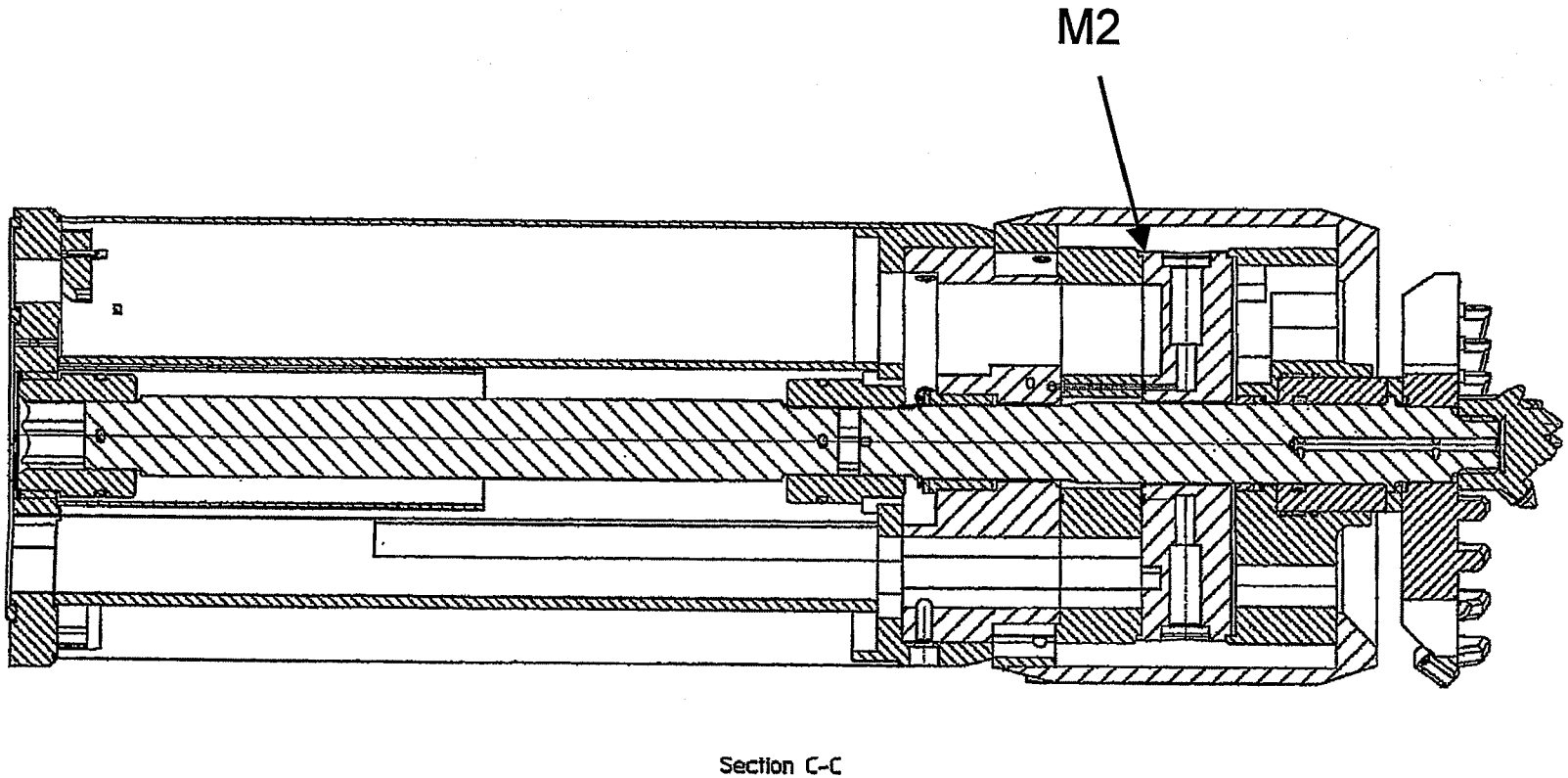
FIG. 6 is a cross sectional view of the enclosed drill head with front cutting means of FIG. 3 through section C-C.
Figure 7B:
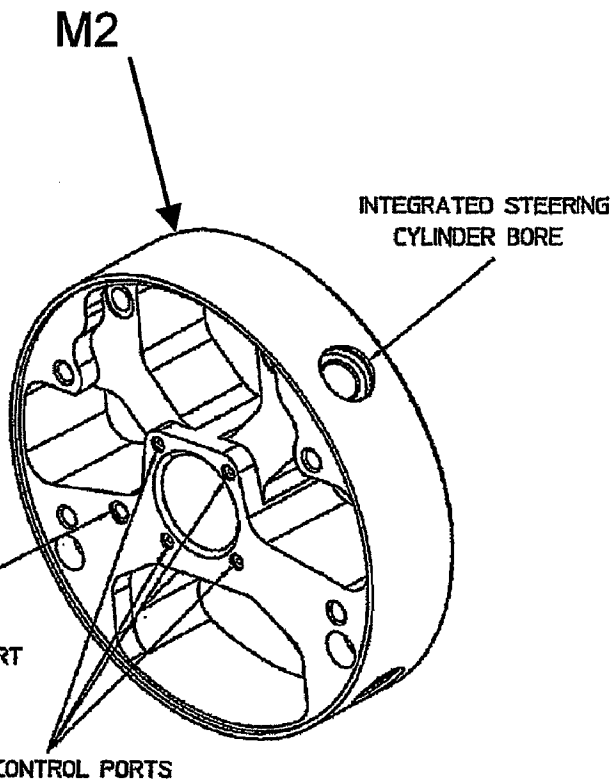
FIGS. 7A and 7B show front and rear perspective views of the steering module of the drill head of FIG. 2.
Figure 7A:
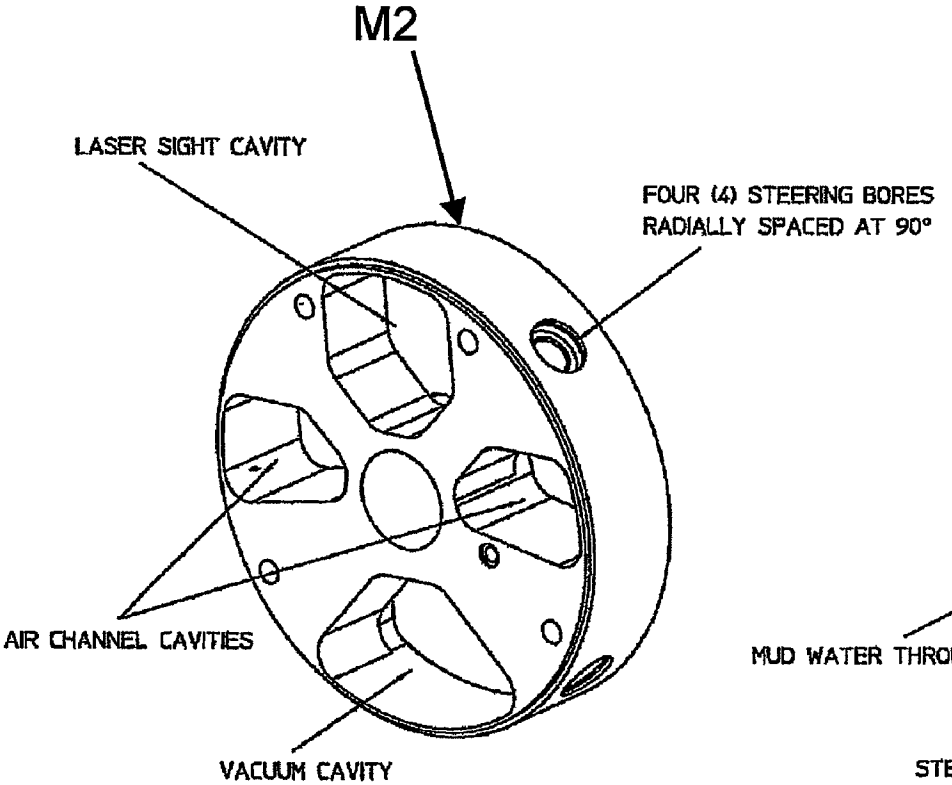

Attached to the distal end of the last intermediate drill rod (41) is attached a drill head (20) shown in exploded view in FIG. 2 and in cross sectional views in FIGS. 4, 5, and 6. As such a drill rotor assembly (21) connected to the end of the drill shaft or drill rod (22) and connecting to intermediate drill rods (23) form a continuous drill string that is driven by the external drive means (11) comprising the hydraulic thrust module (13), reciprocating a rotation module (14) and linearly movable on the rack and pinion gearing system (12).

Figure 16B:
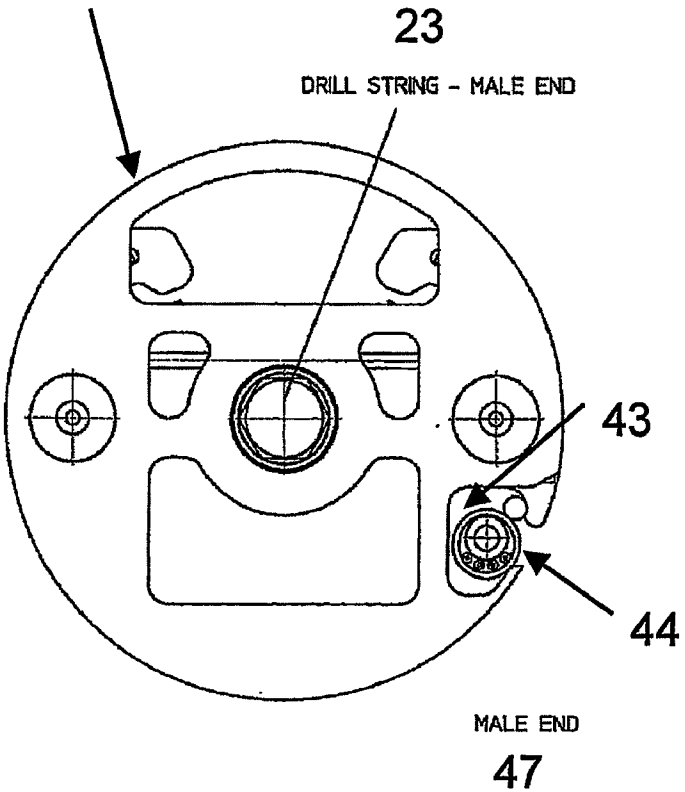
FIGS. 16A and 16B are respectively female and male end views of the drive rod of FIGS. 14 and 15.
Figure 16A:
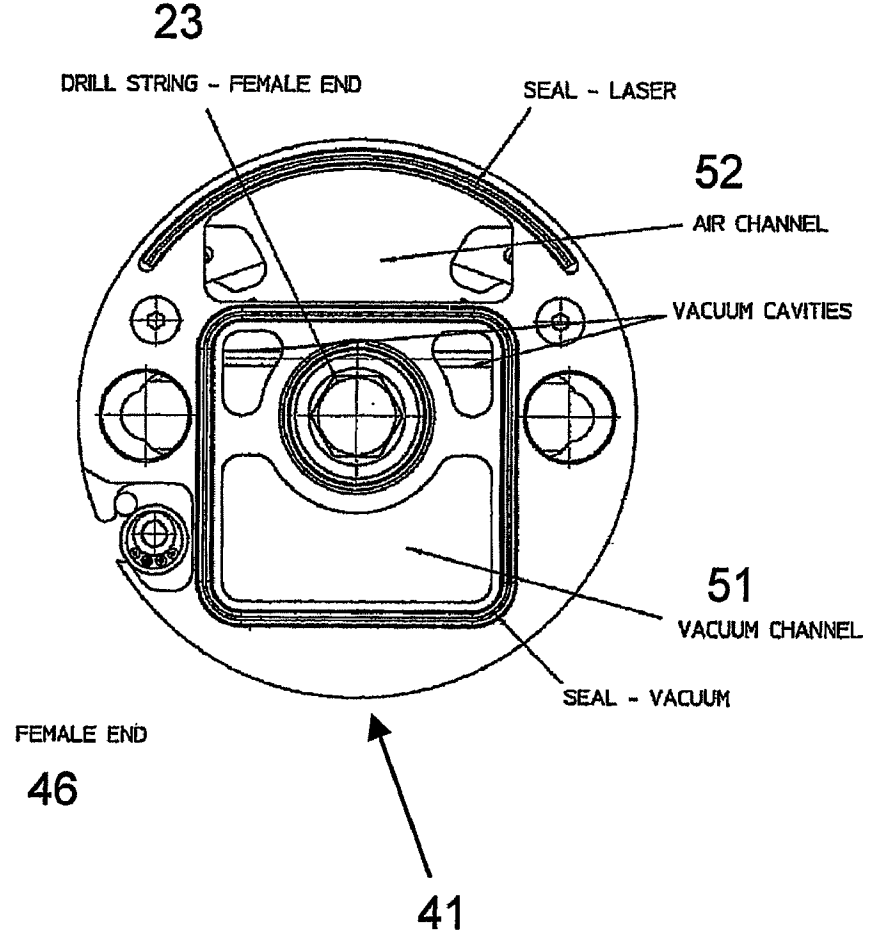

The casing (42) of the intermediate drill rods (41) and the casing of the drill head (20) formed by the steering shell (M6) and the rear shell (M5) form a continuous covering of the continuous drill string with internal defined continuous bores or channels. In particular a vacuum channel (51), as shown particularly in FIGS. 16A and 16B, can be formed by a number of continuous cavities extending along the length of the intermediate drill rods (41) to the drill head (20). This vacuum channel (51) has vacuum seals at connecting female end (46) to maintain vacuum between longitudinally engaged and aligned intermediate drill rods. Within this vacuum channel 51 is located the connecting intermediate drill rods (41). A separate air channel (52) is formed by a separate number of continuous cavities extending along the length of the intermediate drill rods (41) to the drill head (20). This forms a linear channel within which the controlling laser can penetrate to the drill head (20). By the separation of the heat generating drill rod (22) to the linear laser channel and the cooling effect of the return slurry along the vacuum channel (51) creates a highly effective and accurate steering mechanism.

The microtunnelling system and apparatus further includes:

a) drill head with fluid bearing bush and modular construction
b) enclosed drill rods with internal cooling system
c) pullback extraction reamer
d) rack and pinion thrust module with rotation unit
e) rod loading system
f) microprocessor control system.

In use upon excavation of a launching shaft, the base of the shaft would be prepared for the installation of the drilling machine. The shaft would typically have a pipe invert start point already marked and a line surveyed. A laser 100 would be set up in the shaft at the extreme rear on line and grade. Thick boards are typically placed along the base of the shaft horizontally on grade. The microtunnelling drive means (11) including thrust module (13) and rotation unit (14) is lowered into the shaft and set up on line and grade.

The drill head (20) is lowered into the shaft and data, hydraulic and pressure fluid lines (44) are attached to the drill head (20). The drill head size and ground conditions are entered into the control panel which selects appropriate parameters for drill thrust speed and force, drill rotation speed and torque, vacuum flow and pressure, and pressure fluid flow. The drill head is attached to the vacuum thrust adaptor mounted on the rotation unit. Once set in launch mode, the vacuum unit is started and the pressurised drill fluid is actuated to eject at the drill face. The drill head is launched into the earth face.

Figure 13:
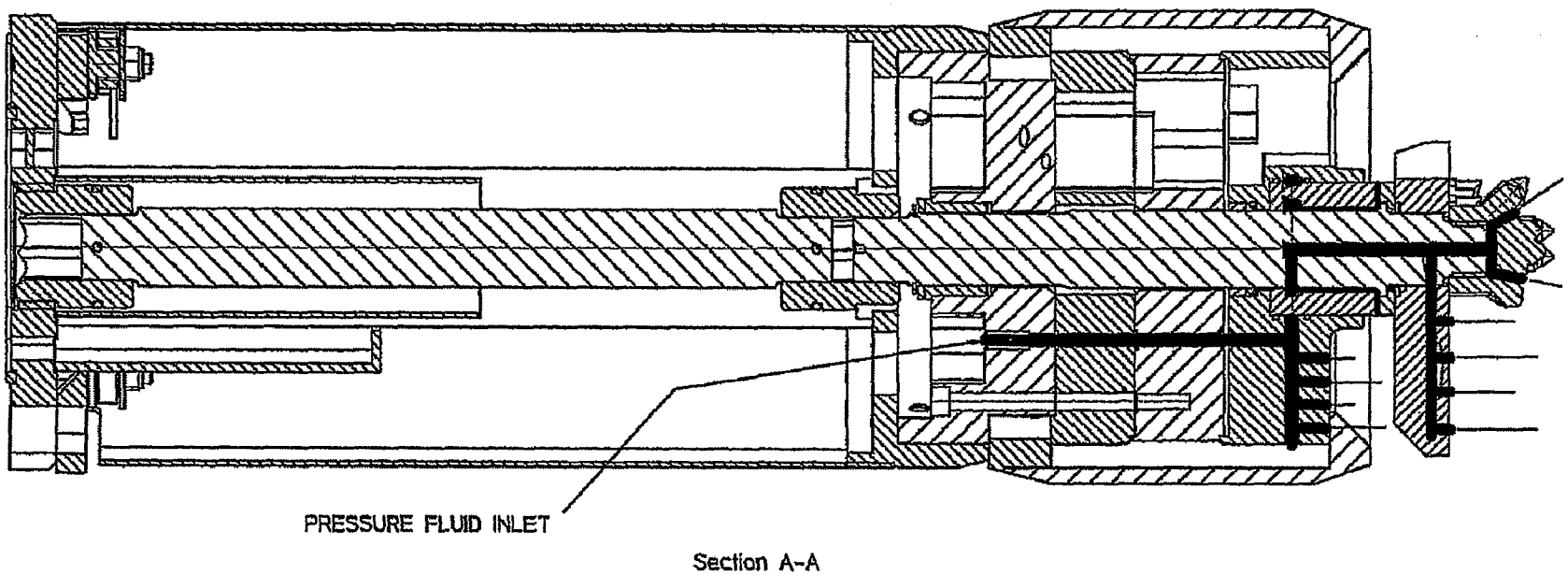
FIG. 13 is a cross sectional view of the enclosed drill head showing the pressure fluid path through the modules to the bearing module and the front bearing bush supporting the front cutting arm.

The hole is cut via a combination of rotating cutting tooling and assisted by ejecting pressurised fluid. This pressurised fluid flow, which also acts as a fluid bearing, is shown in bold in FIG. 13. Whilst drilling, the drill head (20) is thrust into the ground with the slurry/spoil being vacuumed up by a vacuum source 102 back into vacuum pipe (15) and into a waste tank 104 for removal. Once the drill head is completely in the ground the thrust, rotation, vacuum and pressure fluid is stopped. The drill head is detached from the vacuum thrust adaptor, and the thrust trolley with rotation unit return to the starting position.

Figure 17:
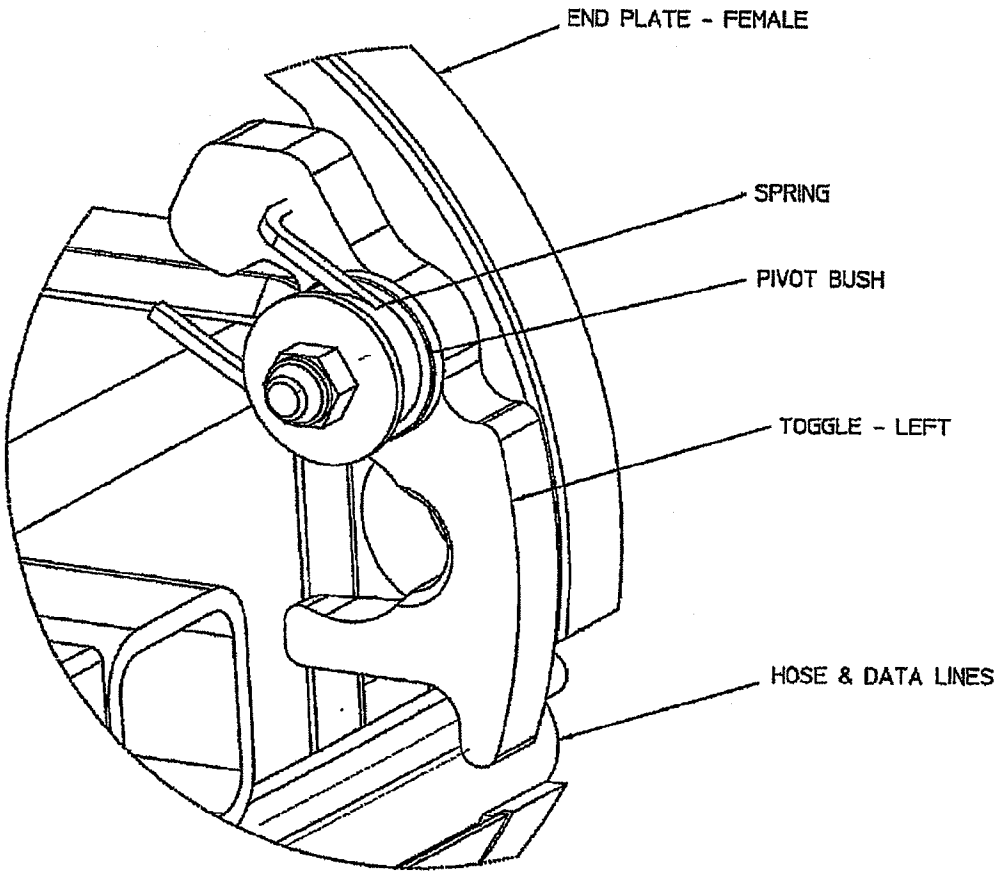
FIG. 17 is a perspective detailed view of the drill rod of FIGS. 14 and 15 showing the toggle locking mechanism.
Figure 18:
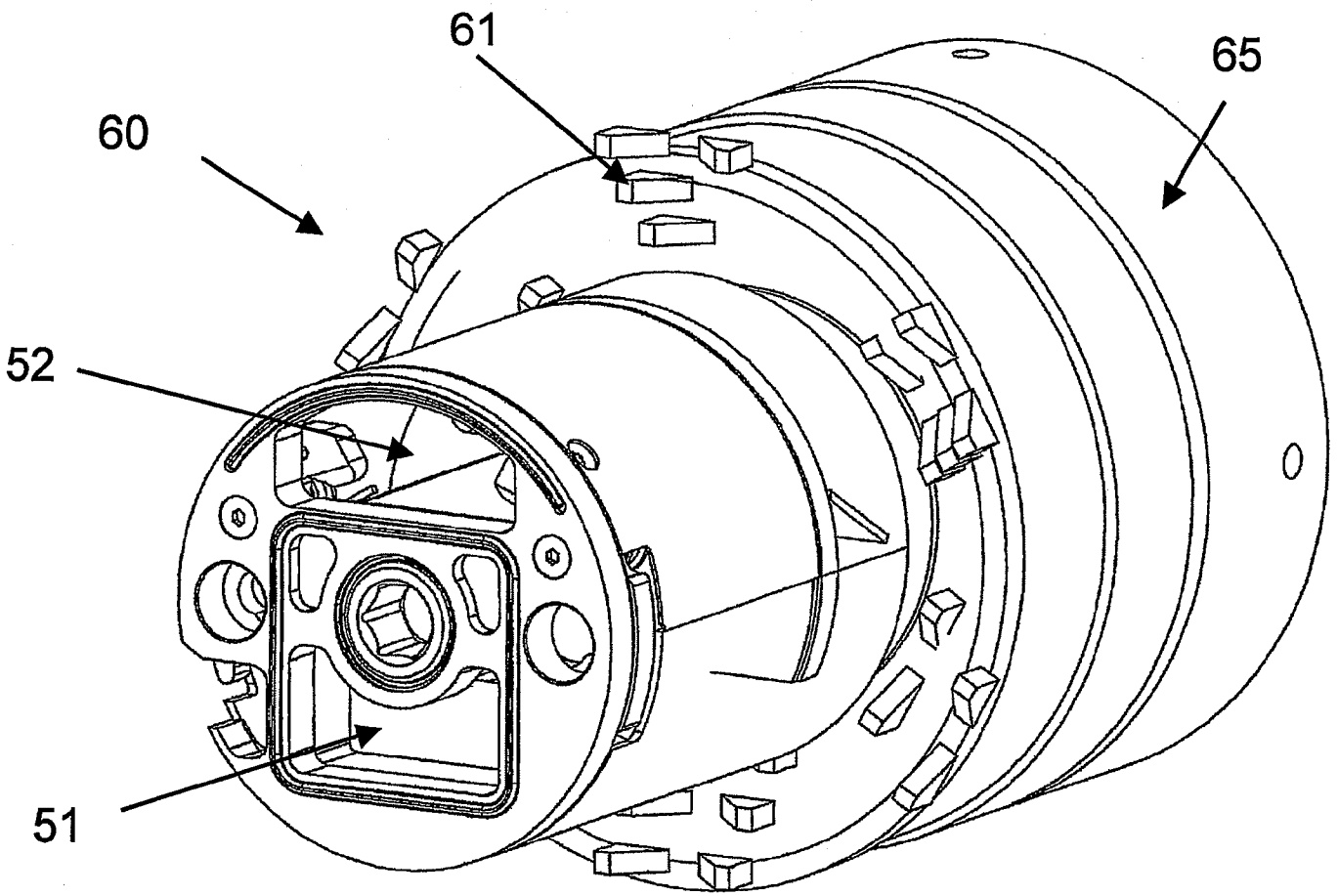
FIG. 18 is a rear perspective view of a vacuum assisted precision reamer showing the connection means to the drill rod and rearward facing cutting face.
Figure 19:
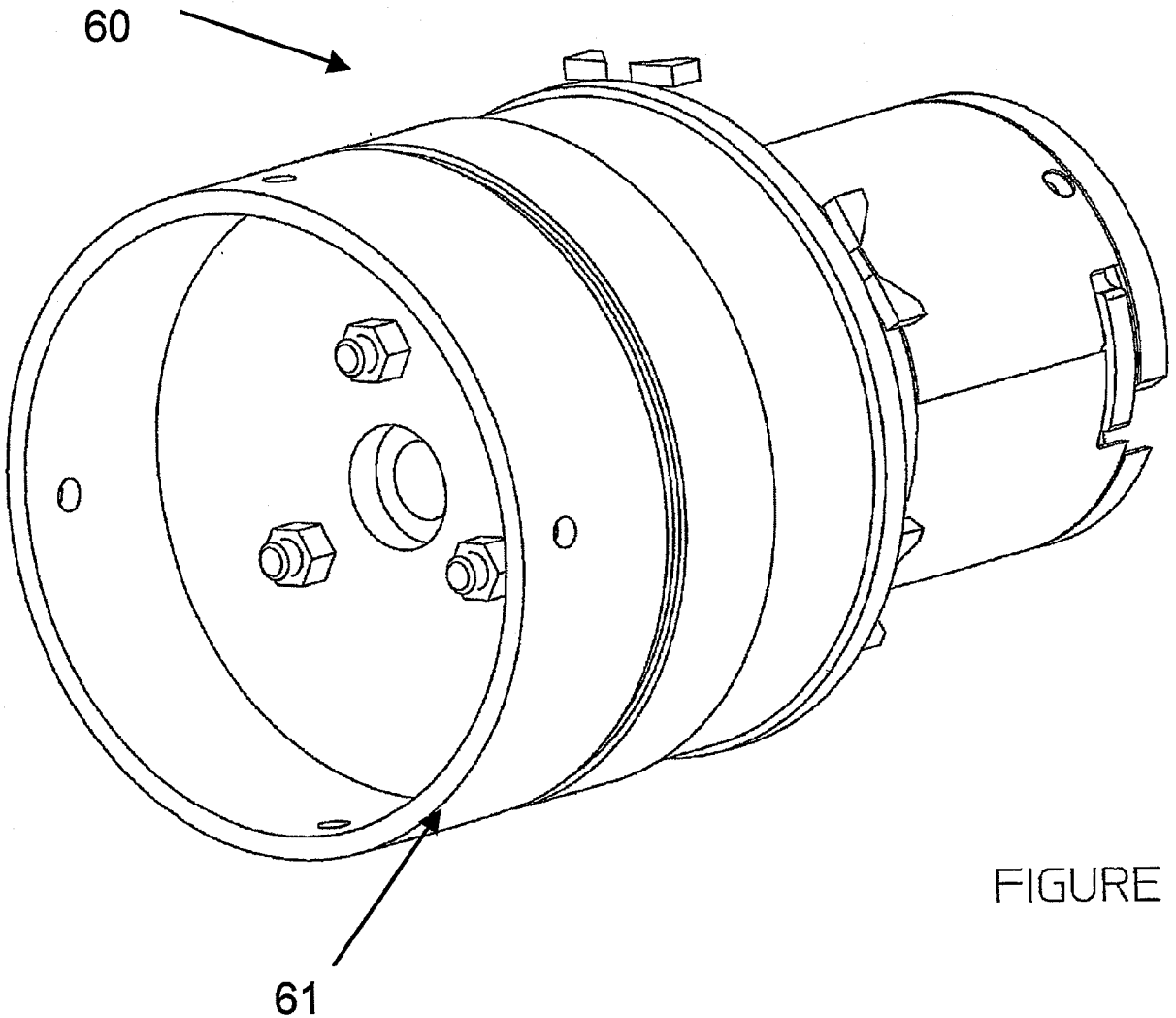
FIG. 19 is a front perspective view of a vacuum assisted precision reamer of FIG. 18 showing the connection means to the product pipe to be installed.
Figure 20:
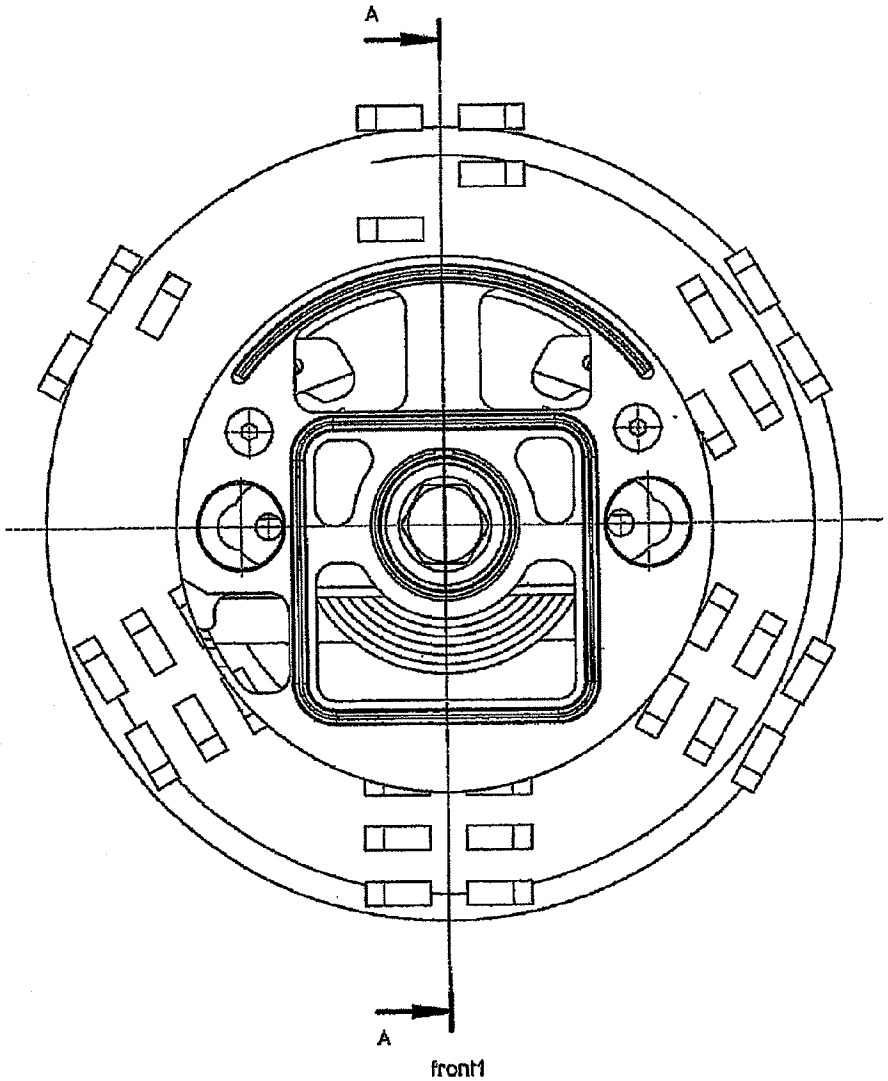
FIG. 20 is a rear perspective view of a vacuum assisted precision reamer of FIG. 18.
Figure 21:
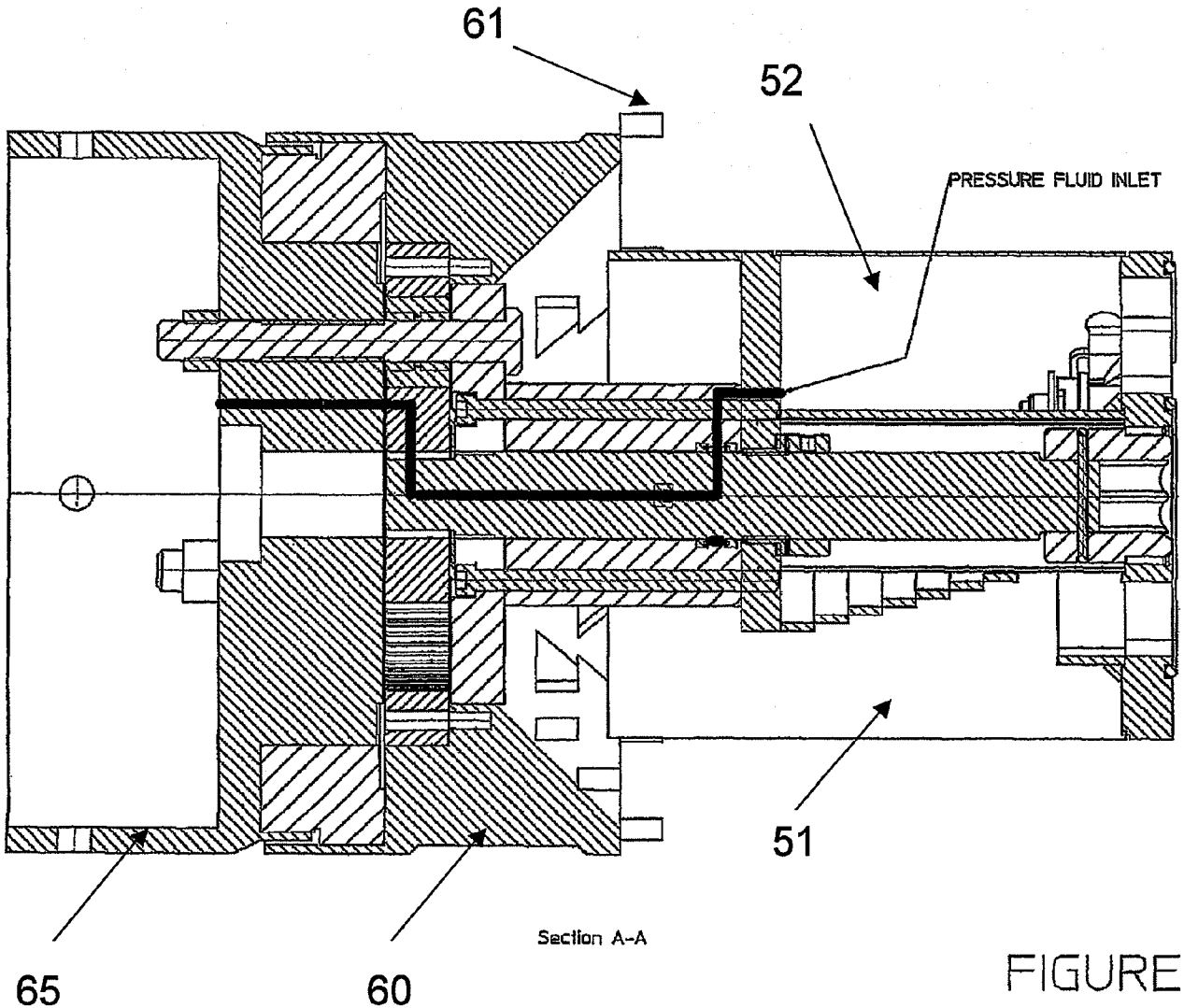
FIG. 21 is a cross-sectional view through section A-A of FIG. 20 of a vacuum assisted precision reamer of FIG. 18 showing the internal pressure fluid passages, vacuum cavity, air channel, input drive shaft, planetary gear set, cutter hub and bearing.

Once in the start position an intermediate drill rod (41) is loaded either manually with a crane or via the use of the automated rod loader. Once the drill rod is sitting in the bed of the thrust module the thrust trolley and rotation unit are started at low speed, low thrust and low torque respectively to engage the drill rod. The rod engagement is automatic in that the drill rod has self-aligning pins (48) that accurately aligns the rod to both the drill head and the drill machine. Upon full alignment and further forward travel, the self-locking toggles (shown in detail in FIG. 17) engage behind the locking pins to affect a solid connection. Control hoses and cables (44) are inserted into the concave cavity (43) of the outer cover or casing (42) encasing the drill rod (23). Vacuum and pressure fluid resume with the drilling process reverting to preset drilling speed, thrust and torque. This process is continued until the final bore end point is reached.

Operation of the microtunnelling machine is performed remotely via a control box, which displays all the current pressure and speed settings. The control box is computerised and integrates the control of the steering, thrust module, rotation unit, vacuum unit and the pressure fluid. The operator can adjust any of the parametric settings to perfectly suit the current ground conditions. Both the drilling process and the steering process can be automated via the use of integrated computer software and can also be manually controlled. Throughout the drilling process the drill position is monitored via the laser hitting a target positioned in the drill head (20) and viewed through the use of closed circuit television (CCTV) so that the operator or software package constantly steers the drill head to keep the laser in the centre of the target.

Once the bore is complete there are three options; progress the drill rods into the reception shaft whilst inserting jacking pipes, pull back to the launching shaft whilst trailing a pipe directly behind it, or remove the drill rods prior to pipe insertion.

Currently, the microtunnelling industry only allows for forward excavation. The current invention is the only system of microtunnelling that incorporates precision back reaming. As shown in FIGS. 18 to 21 there is provision for the drill head (20) to be replaced by a back reamer (60) that is similarly connected to the intermediate drill rod (41) and driven by the drill string and external drive means. However instead of forward facing drill rotor assembly (21) of similar diameter to the drill head (20), instead there is a rearward facing reaming assembly (61) of larger diameter to the intermediate casing (42). The pipe can be installed by back reaming and attaching pipe to open cylindrical end housing (65) mounted at the very end of the back reamer (60). Thereby as the back reamer (60) is drawn back by the drive means (11) while undertaking rotational drilling with rearward facing reaming assembly (61) of larger diameter, a pipe of same or smaller diameter is drawn along and laid in the enlarged bore.

Back reaming allows use of low cost reamers to open the hole for different pipe size installations. Back reaming also utilises one size drill head and drill rod for each thrust module which in turn simplifies the rod loading process and reduces overall equipment cost.

Figure 9B:
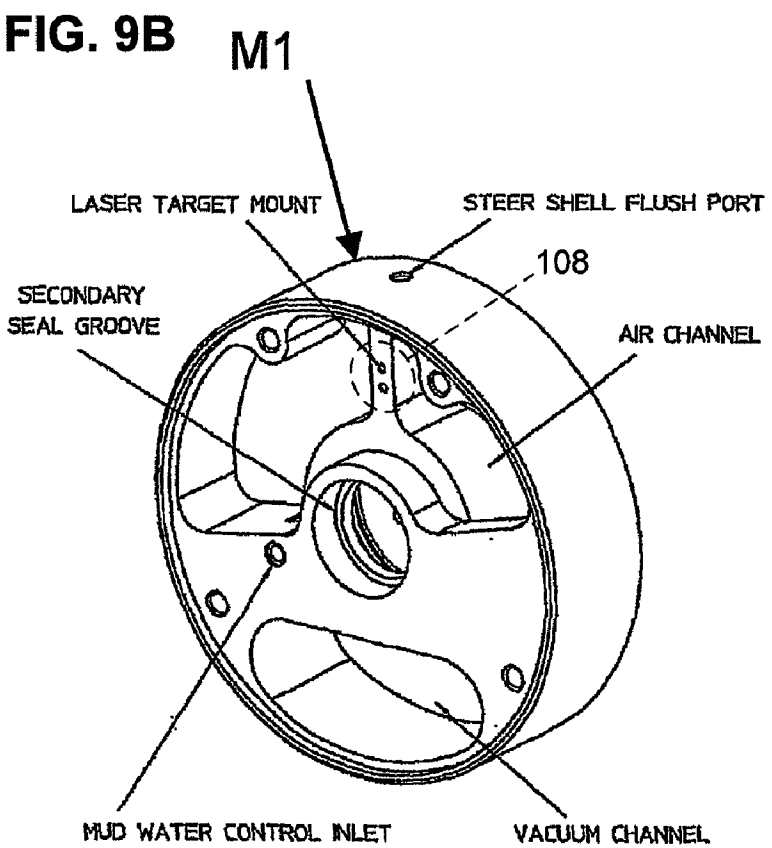
FIGS. 9A and 9B show front and rear perspective views of the bearing module of the drill head of FIG. 2.
Figure 9A:
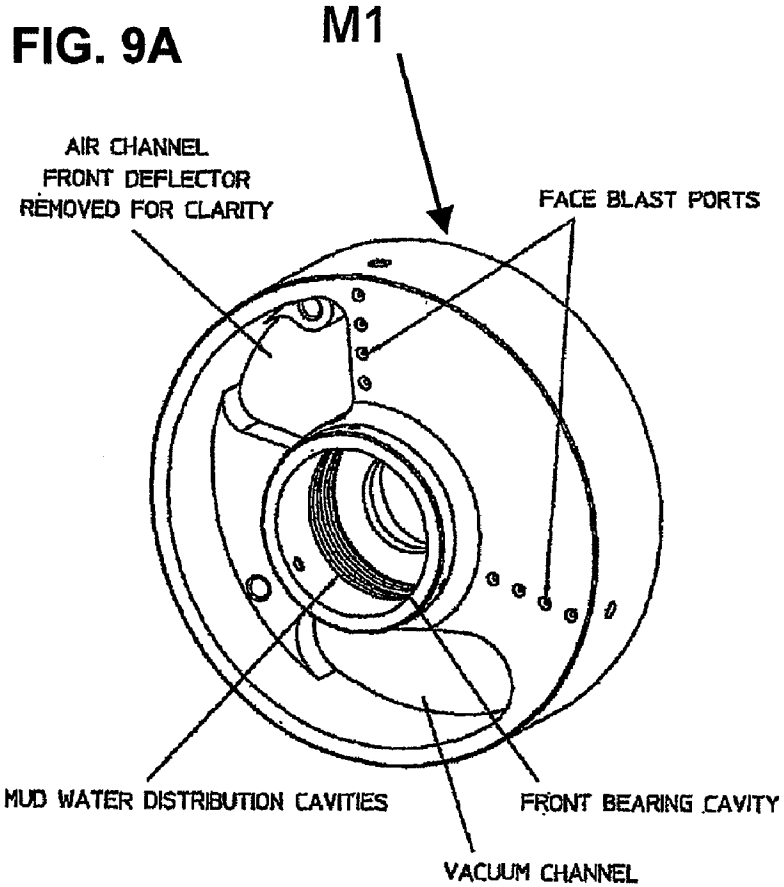
Figure 10B:
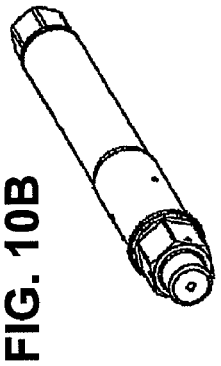
FIG. 10B is a perspective view of the drill shaft of FIG. 10A.
Figure 10A:
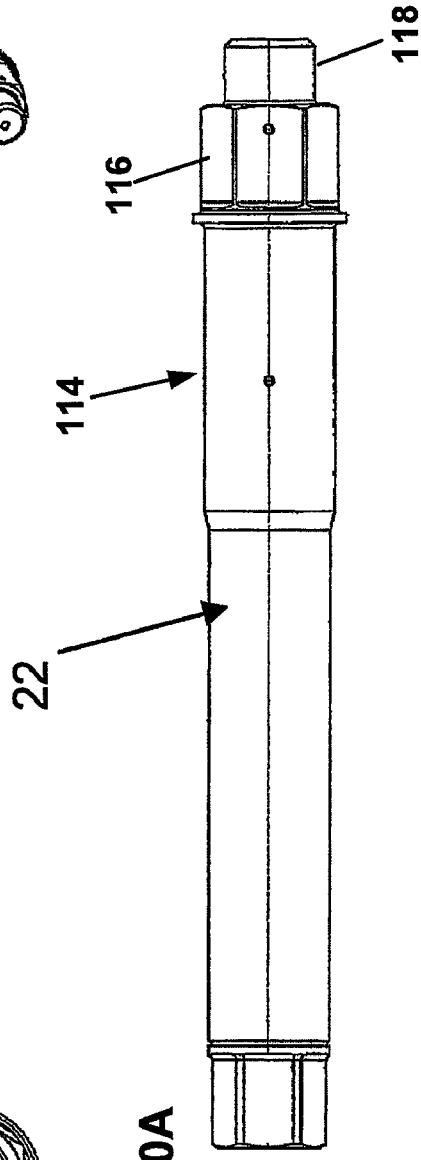
FIG. 10A is a side view of a drill shaft.
Figure 10D:
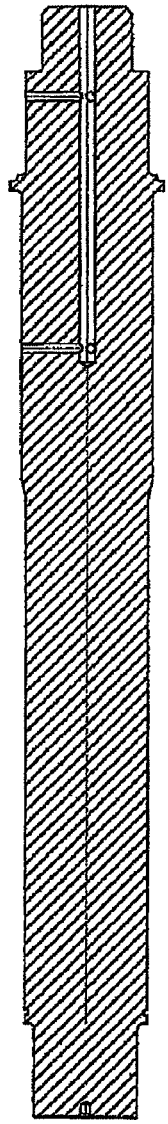
FIG. 10D is a cross sectional view taken along section line 10D-10D of FIG. 10C.
Figure 10C:
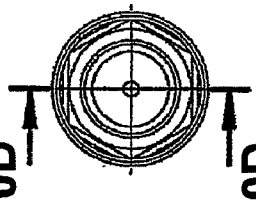
FIG. 10C is an end view of the drill shaft of FIG. 10A.
Figure 11B:
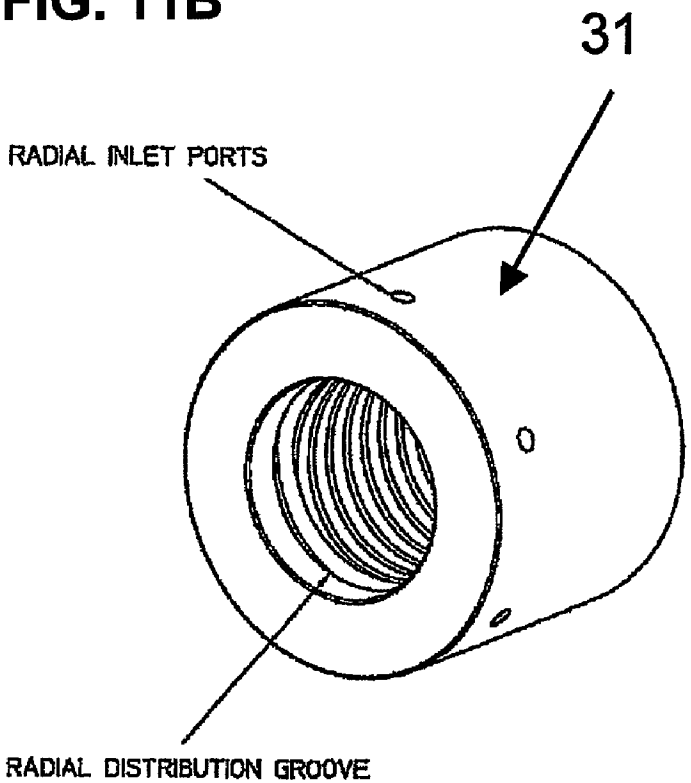
FIGS. 11A and 11B show front and rear perspective views of the front bearing bush of the drill head of FIG. 2.
Figure 11A:
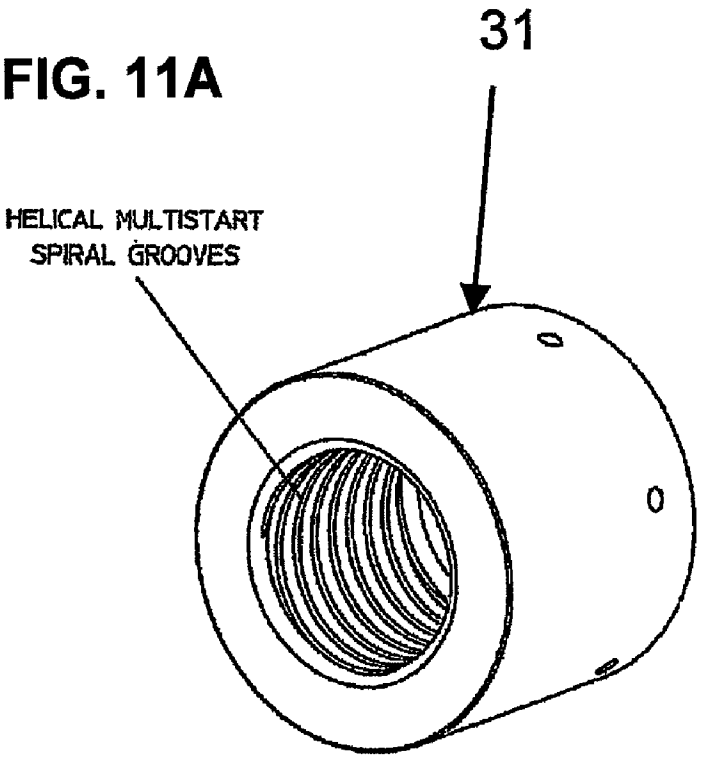
Figure 12B:
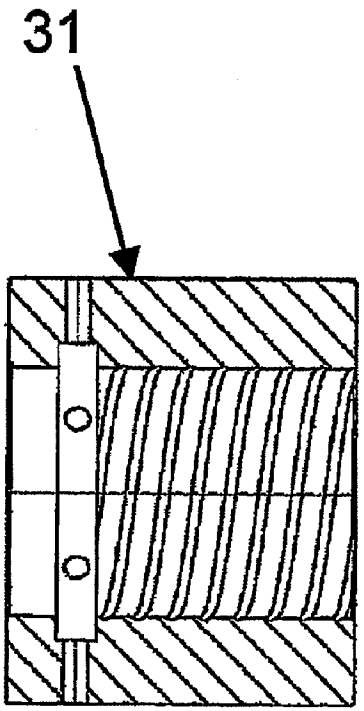
FIG. 12B is a cross sectional view through section line 12B-12B of FIG. 12A.
Figure 12A:
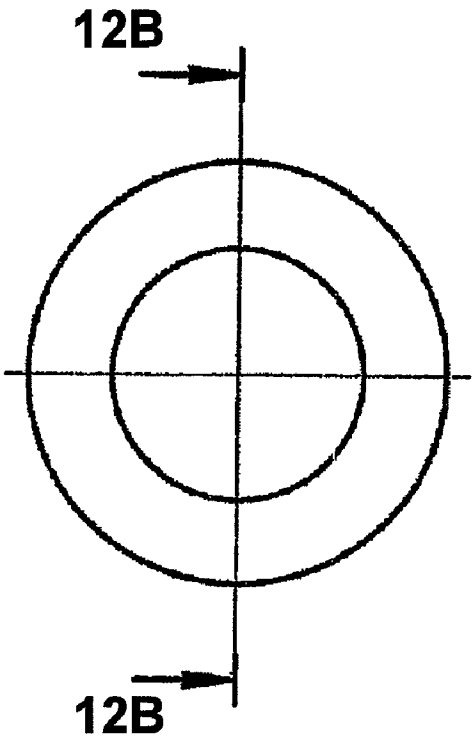
FIG. 12A is an end view of the front bearing bush of FIGS. 11A and 11B.

Looking at the apparatus in further detail the system includes:

Guidance system with a laser beam 106 (see FIG. 1) striking a target 108 (see FIGS. 1, 9A and 9B), which IS monitored to constantly maintain an accurate position.

Vacuum: Use of vacuum allows for clean operation, fast extraction minimising regrind and Vacuum also reduces volume area occupied by extraction unit Pressure Fluid: Allows for enhanced cutter life whilst creating greater option via the use of drill fluid when dealing with different drill conditions.

Drill rods: providing the ability to push or pull means that we can cut in both directions. This allows the machine to essentially drill a pilot hole accurately on the thrusting forward of the line and then cut back or open the hole as you pull back. As the line and grade of the hole is already determined the tooling required is simplistic and inexpensive which allows the machine to be more versatile through a large range of hole sizes at minimal cost. Pulling back in microtunnelling is unique. By only using one sized drill rod for each unit the jacking frame can be customised to automate the loading and unloading of the drill rods. With automated loading and unloading of drill rods the system reduced the need for man entry whilst operating. This enhances safety on the worksite.

The thrust module, which is installed in the launching shaft, can provide 300 kN force for thrust and pullback of 2.5 metre stroke within a longitudinal space of 3.0 metres. The thrust module uses rack and pinion gearing for increased stroke to retracted length ratio. It provides a high load capability with positive force. Pressure, force and speed are fully adjustable for both thrust and pull back and have a programmable stroke with adjustable limit stops for the trolley assembly. Overall the thrust module allows fast drop in boxes for the rotation unit.

A variety of rotation modules can be selectively utilised with the one thrust module according to the requirements. Rotation modules ideally cater for one drill diameter, by maximising available hydraulic power, rotating at ideal speeds (rpm) by maintaining optimum cutting face surface speeds (m/min) to best utilise working range of tungsten and carbide cutting inserts, and by maintaining the most desirable cut face/vacuum area ratio. Other sizes of rotation modules can also be used but with less efficiency.

Each rotation module comprises its own hydraulic motor (low speed/high torque, high speed/low torque, two-speed automatic selective unit, or other) coupled through a drive train assembly (chain and sprockets, simple gear box, planetary gearbox, or other) to rotate a drive shaft with a hexagonal end, which is to be coupled to the drill string inside the drill rods.

Each rotation module also includes a Vacuum thrust adaptor for connection with drill rods. This vacuum thrust adaptor incorporates the features suited to each drill rod, being vacuum sealing method, drill rod alignment, drill string torque transmission connection, thrust face and pullback connection. The Vacuum thrust adaptor also houses any hydraulic clamping and disconnection mechanisms for drill rods.

The microtunnelling machine targets extremely precise small diameter trenchless pipe installations particularly <600 mm and more particularly <300 mm. This is achieved by tracking a laser striking a target in the drill head, which is monitored via CCTV in the drill head and then steered accordingly to maintain line and grade. A unique fluid bush assembly transmits water and thrust to the rotating cutting face, where the pressure water and subsequent cutting spoil are mixed to a slurry for removal by vacuum extraction.

The drill head utilises a unique radial steering system capable of directly variable directional changes to continually and precisely cut the bore hole. The drill head is progressed through the ground by connecting subsequent drill rods between the drill head and thrust module until final bore length is achieved. These drill rods are either encased or open and combine rotation shaft/drill string, vacuum, air and control channels providing mechanical and control workings. Hydraulics, water and data is remotely controlled and utilised by the operator at the remote control panel and conveyed by cables and pressure hoses.

The front cutting rotor assembly consists of tungsten, carbide or other sintered hard metal inserts housed both axially and radially on a variety of face styles. The shape of the front cutting face varies remarkably with ground conditions, and can be flat, piloted or conical in shape and is built to suit.

All front cutting rotors are designed so that cuttings large enough to potentially block drill head vacuum cavity are kept ahead of cutters for further processing (mixing, cutting, grinding or shattering). Once cuttings are small enough, they are permitted past the cutter face for vacuum extraction.

A clay cutting face will have a multitude of spokes (range from 3 to 6) possibly connected together again to an outer rim. The main consideration is the clay consistency, as the openings through the cutting face are calculated to restrict cut spoil ahead of the cutter until small enough to be able to fit through the vacuum chamber of the drill head. When clay is soft it is easy to drill, but builds on itself and can cause blockages if the correct cutter is not chosen.

A shale cutting face will be similar to the clay version, but face openings are modified to allow for front regrind of large chipped material prior to vacuum extraction.

A rock cutting face generally comprises a cutter face with three, six or nine conical roller assemblies with peripheral openings (usually three) for cutting spoil extraction. Utilising multiple small diameter conical rollers, each set of three are staggered in distance and angle from the front face. The inner set of three cones being most forward, the intermediate set radially skewed from the inner at 60 degrees and setback by 25-100% of the cut diameter, and the final set again radially skewed from the intermediate at 60 degrees to bring the inner conical portion back in line with the radial centre-lines of the inner set of cones, and setback from the intermediate face by another 25-100% of the cut diameter. Roller cutter face then has the benefit of continual steering capability, increased stability in non-homogenous ground conditions, and increased chip rate resulting in less regrind time prior to vacuum extraction of spoil.

Downhole drilling technology has been using "tri-cone" rollers to cut rock for decades. They are available in a variety of grades—soft, medium and hard formation. A tri-cone roller utilises three conical rollers, equispaced at 120 degrees, fitted with hard metal inserts each rotating about their own bearing shaft. The conical shape of each roller, tapered into the centre of the cutting face, rotating about an axis skewed 60 degrees forward in towards the centre of the cutter results in a full flat face cut diameter. The resultant large flat cutting face is very difficult to maintain stability in non-homogenous ground, and due to the size of three rollers required to obtain the full cut diameter, the axial distance travelled prior to any steering response is often half the cut diameter.

All front cutting rotors have pressure fluid ports. Holes are drilled radially to the centre of the cutter to coincide with the porting on the drill shaft. Additional holes are drilled axially from both the front and rear faces of the cutter. These holes are sized approx 2 mm diameter to allow extreme pressure at face for best cutting and mixing qualities with minimal pressure fluid usage. An internal chamfer on front ports to increase surface area at opening only to allow for blockage ejection. Rear ports are directed back towards drill head to aid in clearing any residues from air channel and vacuum cavity.

All front cutting rotors have a central cavity for connection with the drill shaft in the drill head. This cavity is either threaded with a trapezoidal or acme thread taking up onto a shoulder on the shaft, or a hollow hexagon for the quick connection arrangement used in conjunction with a front threaded cone and lock bolt. Both styles accommodate for through shaft and cutter pressure fluid transmission.

The drill head drives the front cutting rotor by way of the drill shaft. The front of the shaft is a male hexagonal drive, with 75-100% of across flats dimension of the hexagon in length, with a front threaded extension generally 50-75% of the across flats dimension of the hexagon in diameter, and 75-100% of the thread diameter in length.

The drill rod is radially drilled (eg 3×5 mm diameter holes at 120 degrees) through the faces of the hexagonal final drive through to a central larger axial port (eg 8 mm-12 mm diameter). This axial port is drilled as a blind hole into the drill shaft, to the length corresponding to the position of the front fluid bush. Here, another series of smaller radial holes are drilled through to meet with the axial port (eg 3×5 mm diameter holes at 120 degrees). These holes are peened (eg 8-10 mm concave diameter) to eliminate any seal degradation from the rotating shaft.

The front fluid bearing bush encapsulates this mid-front section of the drill rod and provides a centralised bearing location capable of high radial and thrust forces combined. The peened radial holes of the drill rod are longitudinally aligned with the internal radial pressure fluid distribution groove of the fluid bearing bush.

This groove is in turn fed pressure fluid from radial drill holes (eg 6×5 mm diameter holes equispaced at 60 degrees). Fluid cannot escape to the rear of the fluid bush due to an energising U-cup seal placed at the rear of Ml bearing module. Pressure fluid is proportionally distributed—to the drill shaft axial port through to the front cutting rotor, creating back pressure to distribute to the annulus area between the outside diameter of the drill rod and the inside diameter of the fluid bush. This is achieved by high helix angle, low depth multi-start grooves machined on the inside of the fluid bush from the front edge of the distribution groove to the front face of the fluid bush (eg triple-start, 20 mm pitch 0.5 mm deep grooves with 1.5 mm concave radius). This pressure fluid is then channelled to a helical spiral groove on the front face of the bush (eg single 10 mm pitch continuously decreasing right-hand 0.5 mm deep face groove with 1.5 mm concave radius). This channelling effect essentially hydrostatically separates the shaft from the bush both radially and axially, to counteract steering and thrust face forces. The relationship is linearly proportional in that the higher the load, the harder the faces act against one another, providing a greater hydrostatic seal, which in turn acts to repel the two components. Hence we have a bearing, which mechanically transfers load, provides a pressure fluid swivel, and continually lubricates and cools itself. This method allows a very strong shaft construction with minimal stress riser points, and excellent pressure fluid conveyance.

The drill head functions to drive the front cutting rotor by means of a drill rod. The bore hole position is monitored within the drill head by means of a laser set at the launch shaft indicating a position on a target mounted in the drill head. A camera within the drill head is directed at the target, and relays a video image to a video screen viewed by the machine operator. The operator controls any required steering direction changes. Steering is achieved by altering the position of the cutting face relative to the bore hole.

The prior art was to manufacture a cylindrical drill head, and moving the cutting face. One steering method is to pivot the front portion of the drill head vertically and horizontally. Although effective in steering, this required the laser target to be situated a considerable distance from the cutting face. The further rearward the laser target position, the further the distance is required to be drilled prior to an update of current bore face location.

Another steering method is to move the drill shaft within the drill head. This has the advantage of being able to mount the laser target further forward in the drill head, and therefore, providing a more accurate target to bore face position. However, the pivotal mounting of these steering mechanisms provides a weak steering with high failure rates and increased maintenance.

These past methods of steering are physically large and cumbersome, and due to plumbing required to each hydraulic cylinder, makes this method unsuitable to small diameter drill head design. The invention entails construction of a modular drill head for increased strength and reduced size.

The drill head is of a segmental modular design to minimise overall size while achieving maximum strength and durability. Each module is centralised and retained by the next module by male and female stepped spigots. Clamping of each module achieves angular alignment and axial clamping. Each module is designed for its particular purpose in the drill head, and all hydraulic, fluid, air and vacuum channels are interconnected by way of stepped face seals. It is this method of construction that allows the use of integrated pressure porting, reliable bearing design, maximum vacuum area, good air channel ducting, maximum forward position of laser target area and plumb indicator for visual head tilt indication.

The drill head and steering module for use in the microtunnelling system has a steering shell M2 mounted axially on the drive rod (22) in a manner to allow radial movement and having a plurality of radially mounted pistons able to engage the inner surface of the steering shell M6 such that the control of the protrusion of the plurality of radially mounted pistons controls the direction of the steering shell.

Figure 8A:
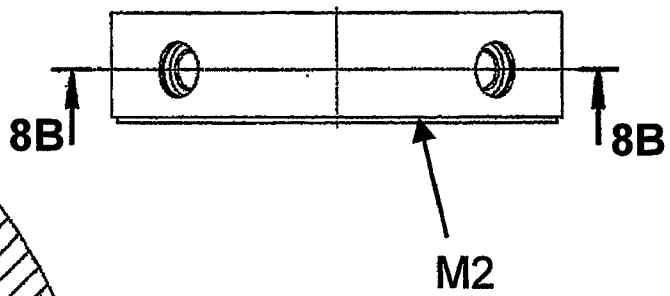
FIG. 8A is a side view of the steering module of FIGS. 7A and 7B.
Figure 8B:
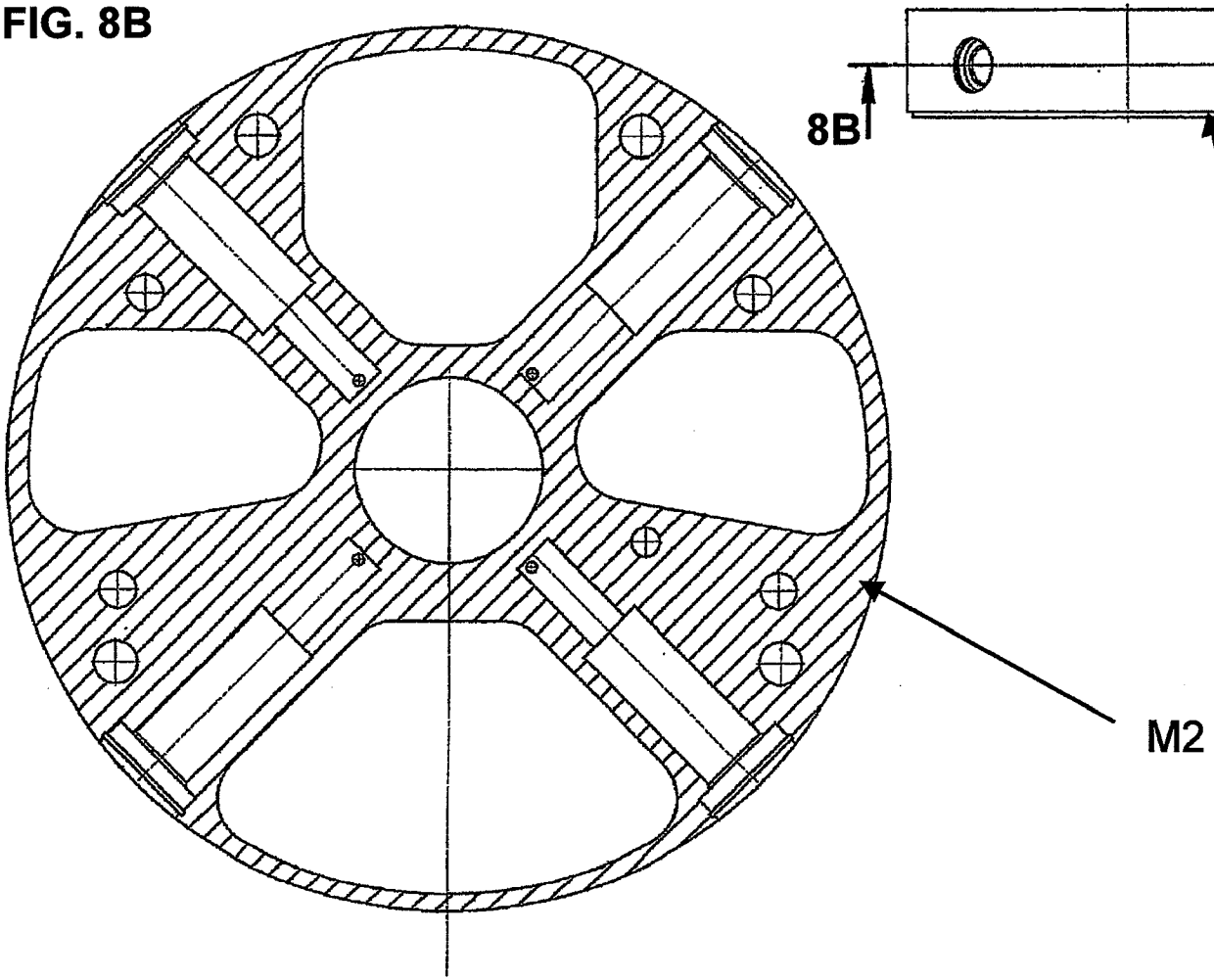
FIG. 8B is a cross sectional view through section line 8B-8B of FIG. 8A.

As shown particularly in FIGS. 8A and 8B, the plurality of radially mounted pistons is included in a circular steering module fitting around the drill rod and having radial bores from which the radially mounted pistons protrude. The circular steering module includes a spoked wheel effect with the radial bores extending at least partially along the radial extending spokes. Preferably cavities are between the spokes to allow axial pathways. The circular steering module includes ports near the radial centre and able to receive water or hydraulic fluid for driving the pistons to protrude from the radial bores and engage the inner surface of the steering shell.

As shown in FIG. 2, the drill head includes a modular construction having a plurality of circular disc like elements for axial alignment and abutment and mounting within a cylindrical shell, wherein each of the circular disc like elements is created by direct bore construction and the axial alignment and abutment creates continuous axial and radial channels allowing fluid flow, vacuum waste return channel, and control flows.

One of the circular disc like elements forms a bearing module M1 at the front of the drill head with flow paths for providing axially extending fluid jets to assist cutting and radially extending flow paths to assist aquaplaning bearings of the rotating cutting means.

One of the circular disc like elements forms a steering module M2 at the front of the drill head with flow paths for providing axially extending fluid jets to control protrusion of pistons to engage the outer cylinder and alter direction of the drill head.

One of the circular disc-like elements forms a spacer module M3 within the drill head with flow paths for providing axially extending flow paths to adjacent modules.

One of the circular disc like elements forms a mounting module M4 at the rear of the drill head with flow paths for providing axially extending flow paths and able to form non rigid mounting of base of outer cylinder.

The drill rod (22) and connected intermediate drill rods (23) are a steel rod drive shaft, with male and female hexagonal ends to effect connection and resist torsional forces. The drill rod and connected intermediate drill rods are retained within either end of the drill rod end plates by front and rear rod bush bearings. The drill rod and connected intermediate drill rods are housed in an axially extending tubular section (51) to separate the bearings from the spoil through the vacuum section. The axially extending tubular section drill string housing is located fully within the vacuum chamber, surrounded by the vacuum channel and vacuum cavities. It is this full surround by vacuum that functions to absorb heat created by the rotating drill string, transferring it directly to the slurry and spoil cuttings and fluid returning from the drill head, and in turn to the vacuum waste tank.

The laser beam used for drill head guidance travels through the protected top air channel (52). It is the effective removal of heat and creation of a stable laser environment that minimises otherwise unavoidable hot-cold transitions at every drill rod connection. In past drill rods, these hot-cold transitions cause consecutive and culminating laser refraction, leading to an inaccurate borehole.

During connection the drill rods (23, 23) are pushed together. The vacuum thrust adaptor has two conical combination pins (48) in the male drill rod end plate (47) about the rod's longitudinal axis and centred vertically about the drive, and offset equidistant about the horizontal plane. These combination pins have a conical taper at the front and align with two bores (49) in the female drill rod end plate (46) about the rod's longitudinal axis. As the pins are further inserted, the drill rod is aligned to a horizontal plane; the drill rod and connected hexagonal intermediate drill rods are aligned and further inserted until the two end plate faces are mating.

Consecutively during this alignment process, the toggles mounted to the female end plate are caused to pivot about the pivot bush axis, moving radially outwards from the end plate diameter, allowing the major diameter of the combination pins past the toggles. Once the Combination Pins pass the major diameter, the toggles are allowed to spring back to their original position, moving in between the combination pins and the female end plate, thus locking the connection, and allowing either thrust or pullback under load. Once the drill rod end plates are mated face to face, the vacuum and laser space are sealed due to the elastomeric seals inserted in the milled grooves of the female plate.

Referring to FIGS. 2, 4, and 5 the Ml bearing module comprises of a circular disc with a central stepped bore for the location of the front fluid bearing bush. The housing is cross-drilled to divert an axial pressure fluid port originating to the side of the drill rod, connected to a radially drilled port which in turn connects to a radial groove on the inside of the central bore. Two additional smaller radial grooves—one to the rear and one to the front of the channel groove provide housing for o-ring seals which completes this cavity and directs all pressure fluid through to the radial holes drilled through the fluid bush. The radial pressure cavity also connects to a vertical radial port fitted with a jetted plug, which directs some fluid to the Annulus between the steering ring and steering shell M6. At the rear of the Ml bearing module is a self-energising u-cup seal retained by a soft metal bush to complete the front seal cavity.

As shown in FIGS. 2, 6, 7A, 7B, 8A and 8B the M2 steering module comprises a circular disc with a central bore through which the drill rod passes. At the top and to the sides are air channels. At the bottom is the vacuum cavity. There are four radial drillings, bores and counter bores equispaced around the circumference of the disc. Four independent oil ports drilled axially from the rear of the housing and countersunk with face sealing enter the lower portion of the radial drilling in each of the four bores. These bores house the steering pistons with high pressure seals. With pressurised hydraulic oil entering any of these cavities, the associated piston is forced radially outward providing force to move the steering shell M6. The piston is retained from ejection from the housing by a stepped gland ring incorporating a piston rod wiper and auxiliary seal which in turn is retained by an internal circlip within the stepped bore.

The M6 steering shell comprises a hollow tubular section with a front end stepped return section reducing in inside diameter then tapered both internally and externally towards the front. This front stepped return is faced up against the front of M1 bearing module, and the main inner bore has full annular clearance around the circumference of the steering ring assembly allowing the shell to move about radially in any direction. As one piston in the M2 steering module is actuated, the M6 steering shell is forced radially and moves with the extending piston. As the opposing side of the M6 steering shell moves in towards the steering ring assembly, the piston radially opposed to that actuated is in turn retracted, allowing for the next steering manoeuvre. The same applies to the other set of pistons acting about an axis at 90 degrees to the first set of pistons. This actuation on 2-cylinder movement axes, either independently or together allows the drill head to alter its shaft and cutter position relative to the bored hole thus providing steering control.

The hydraulically steered drill head has a fast system for changing cutting tooling. Rock capabilities have been enhanced with the design of a rock roller system for the microtunnelling unit.

The drill head has been modified to accommodate the covered drill rod system and designed to allow for the introduction of automated steering. Drill head segmental design allows for strength and durability whilst enhancing the ability to maintain drill head positioning via hydraulic rams holding a position of one circular piece within a second circular ring providing for maximum strength in minimal space.

The drill shaft must rotate freely under high loads, and pressure fluid must be transferred to the drill face. The use of high-pressure fluids out of the drill face allows for enhanced tooling life whilst also giving the ability to flush tacky ground.

The prior art was to retain the shaft within steel bearings, either tapered roller, or ball bearings with needle thrust bearing. This solved the mechanical rotation issue, but brought with it a whole plethora of associated problems to do with sealing bearings from ingress of cutting spoil and water, both ingredients deadly to bearings. Maintenance is increased as seals and bearings have to be replaced regularly. If a bearing was to seize, it would halt the complete drilling process, drill head would have to be removed for overhaul, causing unplanned down-time and site delays.

The prior art for pressure fluid transmission is with a pressure swivel assembly, which rotates about the shaft axis. The swivel construction would be tubular in design with two pressure seals axially opposed to retain a central pressure chamber within the swivel. A threaded inlet port enters this central pressure chamber radially, flows around the axis of the cavity, through a radial hole drilled in the drill shaft, then through an axial hole in the drill shaft to the front face. This design required external retention of the swivel housing to stop it rotating with the drill shaft, causing radial side-loads on one inside face, in turn, causing seal failure and therefore leakage. The seals had to have a high preload to accommodate high pressure, and would wear grooves in the drill shaft, causing leakage. The swivel would be located behind the target position, so any water spray from leaks would upset visual sight of target. Using pipe fittings from the swivel housing with elbows to bring hose in axially beside drill shaft meant size was too large to be used in small diameter drill heads, assembly and maintenance of hose and fittings would be awkward at best.

The invention entails construction of a modular designed drill head, with integrated pressure fluid conveyance cavities. Further, the invention includes the use of a fluid bearing bush to act as a front drill rod bearing and pressure swivel in one assembly. The fluid bearing bush is retained in the M1 bearing module by three grub screws (equispaced at 120 degrees). Pressure fluid directed to the distribution groove in the M1 bearing module is sealed form escaping past the inside of the stepped bush bore and the outside diameter of the fluid bearing bush by means of two O-ring seals on each side of the distribution groove. This M1 bearing module distribution groove is longitudinally aligned with radial drill holes (eg 6×5 mm diameter holes equispaced at 60 degrees) around the perimeter of the fluid bearing bush. These drill holes enter the inside diameter of the bush and are interconnected with an internal radial distribution groove within the fluid bearing bush. Fluid cannot escape to the rear of the fluid bush due to an energising U-cup seal placed at the rear of M1 bearing module.

The fluid bearing bush encapsulates a mid-front section of the drill rod and provides a centralised bearing location capable of high radial and thrust forces combined. The peened radial holes of the drill rod are longitudinally aligned with the internal radial pressure fluid distribution groove of the fluid bearing bush.

Pressure fluid is proportionally distributed—through radial holes in the drill shaft, connecting to an axial port through to the front cutting rotor, creating back pressure to distribute to the annulus area between the outside diameter of the drill rod and the inside diameter of the fluid bush. This is achieved by high helix angle, low depth multi-start grooves machined on the inside of the fluid bush from the front edge of the distribution groove to the front face of the fluid bush (eg triple-start, 20 mm pitch 0.5 mm deep grooves with 1.5 mm concave radius).

This pressure fluid is then channelled to a helical spiral groove on the front face of the bush (eg single 10 mm pitch continuously decreasing right-hand 0.5 mm deep face groove with 1.5 mm concave radius). This channelling effect essentially hydrostatically separates the shaft from the bush both radially and axially, to counteract steering and thrust face forces. The relationship is linearly proportional in that the higher the load, the harder the faces act against one another, providing a greater hydrostatic seal, which in turn acts to repel the two components.

Hence we have a bearing, which mechanically transfers loads, provides a pressure fluid swivel, and continually lubricates and cools itself. This method allows a very strong shaft construction with minimal stress riser points, excellent radial and axial bearing loads, excellent impact resistance, excellent pressure fluid conveyance, minimal assembly and maintenance costs, and is field replaceable.

The position of the target at the extreme front of the drill head ultimately enhances the drills ability to be extremely accurate and responsive to positional changes. The use of high-pressure fluids out of the drill face allows for enhanced tooling life whilst also giving the ability to flush tacky ground. The ability to run drill fluids at the cutting face creates greater efficiencies within cutting and assists our abilities through varied ground conditions. Front bearing combination of high load axial and thrust bearing with a high-pressure fluid and integrated lubrication system.

The drill rods are inserted and connected consecutively with the thrust module to allow bore hole progression while maintaining drill string, vacuum, air channel, hydraulic, pressure and data line connection. The drill rod transmits torque from the rotation unit mounted on the thrust module to the drill head at the bore face via a drill rod and connected intermediate drill rods. The drill rod also transmits thrust from the rotation unit mounted on the thrust module to the drill head at the bore face via a vacuum tube.

The prior art was to have the vacuum tube section aligned longitudinally with the drill string, situated below it, generally to rest on the invert of the borehole. This allows cutting spoil extraction by vacuum.

The vacuum tube has bearing bushes mounted at each end along the drill rod and connected intermediate drill rods axis to retain the drill rod and connected intermediate drill rods, and male and female cleats at each end for connection by means of a manual pin inserted to two holes either vertically or horizontally aligned. The drill string is exposed, causing possible operator injury from the rotating shaft. The connection method with manual pin insertion is tedious, and pin extraction after bore completion is difficult.

The manual connection method required clearance to allow manual connection. This clearance between subsequent drill rods allows each rod to rotate slightly about its axis as a result of drill string rotational torque. This rotation, possibly only 1 degree per rod, extrapolates the error the further the borehole. Final error over a 100 m bore could be a 50-degree rotation, causing an inaccurate target position relative to the start point. This target position is then potentially out by up to 100 mm.

The borehole is not peripherally supported, causing ground collapse in certain ground conditions, thereby blocking laser and target view, and halting drilling operation. The bearings are directly under the laser position, causing hot sections at each end of the drill rod and a cooler section between the bearings. These hot-cold transitions cause consecutive and culminating laser refraction, leading to an inaccurate borehole.

The microtunnelling system uses a casing mounted on the drill rod that includes at least two axially extending cavities or bores wherein liquid is axially transported along one of said axially extending cavities or bores under pressure to the drill head to assist drilling and resulting slurry is vacuum returned along the other of said axially extending cavities or bores. However as drill rods are fully enclosed, and slightly smaller than the drill head diameter allowing the microtunnelling machine to be effective in collapsing ground conditions, under water table, soft or hard ground. The vacuum or slurry spoil extraction volume within the drill rod provides minimum restriction to increase productivity and length of lines achievable. With all moving components enclosed, the drill rod is safer to use.

Rotation within vacuum or slurry spoil eliminates heat from bearings, minimising laser distortion and wear and tear to the equipment. Enclosed laser space for stability of beam. Provides airflow to equalise temperature and humidity, more accurate operation. Automatic alignment system speeds and simplifies operation. Automatic clamping system, for positive joining, withstands full load in both forward and reverse directions. Clamping system maintains strong sealing of vacuum. Fully encapsulated hose and dataline pocket, protecting sensitive data and pressure lines.

The pullback extraction reamer is used to increase the size of a microtunnelled bore hole. This is advantageous for operators as one size microtunnelling drill head and drill rods can be used in conjunction with a pullback extraction reamer in various bore sizes, while maintaining good productivity. Once the drill head reaches the reception shaft, the drill head is removed from the end of the drill rod and replaced by the pullback extraction reamer. The product pipe to be installed can be coupled to the pipe pullback adaptor mounted on the rear. Drilling is now commenced in reverse, or pullback mode. The drill string is coupled to a drive spur gear that rotates three planetary gears fixedly mounted to the vacuum thrust plate. The spur gears are meshed inside an internal ring gear that is fixed to the cutter hub, allowing the cutter hub to rotate at a lower speed but higher torque than its input drive. The cutter hub is mounted to the pipe pullback adaptor by way of thrust and radial bearings. This embodiment allows the drill rod and pullback pipe to remain rotatably fixed and the reamer cutter hub can rotate about the longitudinal axis at a greater torque. The cutter hub is typically concave within its cutting face, so that as it is pulled back through the ground, slurry and spoil are offered to the vacuum or slurry channel entrance for evacuation.

It should be understood that the above description is of a preferred embodiment and included as illustration only. It is not limiting of the invention. Clearly a person skilled in the art without any inventiveness would understand variations of the microtunnelling system and apparatus and such variations are included within the scope of this invention as defined in the following claims.

The invention claimed is:

1. A tunneling apparatus comprising:

a plurality of separate intermediate drill rod units that can be connected together to form a string of intermediate drill rod units and that can be disconnected from one another to disassemble the string of intermediate drill rod units, each intermediate drill rod unit including a first end positioned opposite from a second end, each intermediate drill rod unit including a drill rod drive shaft rotatably mounted within a drill rod casing assembly, the drill rod casing assemblies each including at least first and second separate axially extending passage defining structures that extend generally from the first ends to the second ends of the intermediate drill rod units, the first passage defining structures being aligned with one another when the intermediate drill rod units are connected together such that the first passage defining structures define a continuous first passage that extends along a length of the string of intermediate drill rod units, the second passage defining structures being aligned with one another when the intermediate drill rod units are connected together such that the second passage defining structures define a continuous second passage that extends along the length of the string of intermediate drill rod units, and the drill rod drive shafts of the intermediate drill rod units being connected to one another when the intermediate drill rod units are connected together to allow torque to be transferred through the string of intermediate drill rod units, the drill rod casing assemblies also including outer shells that extend generally from the first ends to the second ends of the intermediate drill rod units, the outer shells having outer surfaces that define outer boundaries of the intermediate drill rod units, the first and second passage defining structures being positioned between the outer boundaries and the drive shafts of the intermediate drill rod units, the drill rod drive shafts not being positioned within the first continuous passage of the intermediate drill rod units and the drive shafts not being positioned within the second continuous passage of the intermediate drill rod units;

a drill head unit mounted at a distal end of the string of intermediate drill rod units, the drill head unit including a distal end positioned opposite from a proximal end, the drill head unit including a drill head drive shaft that extends from the proximal end to the distal end of the drill head unit, the drill head drive shaft being rotatably mounted in a drill head casing assembly of the drill head unit, the proximal end of the drill head unit being configured to be connected to the distal end of the string of intermediate drill rod units, and the drill head unit including a cutting unit that mounts to the drill head drive shaft at the distal end of the drill head unit; and an external drive positioned adjacent a proximal end of the string of intermediate drill rod units, wherein the external drive applies torque to the string of intermediate drill rod units that is transferred to the cutting unit by the drill rod drive shafts and the drill head drive shaft to cause rotation of the cutting unit, and wherein the external drive also applies thrust to the string of intermediate drill rod units.

2. The tunneling apparatus of claim 1, wherein the outer shells include outer cylindrical portions adapted to support a bore being drilled, and wherein first and second passages are fully enclosed inside the outer shells.

3. The tunneling apparatus of claim 2, wherein the drill rod casing assemblies include end plates positioned at the first and second ends of the intermediate drill rod units.

4. The tunneling apparatus of claim 3, wherein the drill rod drive shafts are rotatably retained within the end plates.

5. The tunneling apparatus of claim 3, wherein the drill rod casing assemblies include tubular sections in which the drill rod drive shafts are mounted, the tubular sections extending axially between the end plates, the first passage defining structures being parallel to the tubular sections and being located radially between the tubular sections and the outer shells.

6. The tunneling apparatus of claim 1, wherein the second passage defining structures have outwardly facing open sides that extend along entire lengths of the intermediate drill rod units and provide access to the second continuous passage from outside the outer boundaries of intermediate drill rod units.

7. The tunneling apparatus of claim 1, wherein the drill rod casing assemblies of the intermediate drill rod units are aligned by male and female structures that mate together when the intermediate drill rod units are interconnected and that ensure alignment of the first passage defining structures and also ensure alignment of the second passage defining structures when the intermediate drill rod units are interconnected.

8. The tunneling apparatus of claim 7, wherein the male structures include pins and the female structures include sockets.

9. The tunneling apparatus of claim 7, wherein each intermediate drill rod unit includes two of the male structures in the form of tapered pins positioned at the first end of each intermediate drill rod unit, and two of the female structures in the form of sockets positioned at the second end of each intermediate drill rod unit.

10. The tunneling apparatus of claim 7, wherein the male and female structures are capable of transferring pull-back load between the intermediate drill rod units.

11. The tunneling apparatus of claim 1, wherein the first continuous passage is an air channel for providing air to the distal end of the string of intermediate drill rod units.

12. The tunneling apparatus of claim 11, wherein the drill head casing assembly of the drill head unit includes a bearing structure fixed relative to the drill rod casing assemblies, the bearing structure including a drill head bearing supporting the drill head drive shaft that transfers torque from the drill rod drive shafts to the cutting unit of the drill head unit, and wherein the first continuous passage extends from the proximal end of the drill string to a laser target mounting location provided at the drill head unit.

13. The tunneling apparatus of claim 12, wherein the tunneling apparatus further includes a steering structure, the steering structure including a piston mount fixed relative to the bearing structure and also fixed relative to the drill rod casing assemblies, the piston mount defining a first opening for receiving the drill head drive shaft and a second opening aligned with the first passage defining structures of the intermediate drill rod units so as to cooperate with the first passage defining structures to define the first passage, the first and second openings extending axially through the piston mount, the piston mount supporting a plurality of radial pistons separated from one another by angular spacings, the tunneling apparatus also including a steering shell that surrounds the bearing structure and the piston mount and that can be radially moved relative to the piston mount by the radial pistons.

14. The tunneling apparatus of claim 13, wherein the plurality of pistons includes 4 pistons which are each angularly separated from one another by about 90 degrees and which are supported by the piston mount, and wherein the second opening extends axially through the piston mount at a location between two of the pistons.

15. The tunneling apparatus of claim 1, further comprising a backreamer that replaces the drill head unit at the distal end of the string of intermediate drill rod units for use in backreaming a tunnel that has been bored by the tunneling apparatus, wherein the external drive is capable of applying a backreaming pull-back load to the string of intermediate drill rod units for use in backreaming the bore, and wherein the intermediate drill rod units are interconnected by connections capable of transferring pull-back load between the drill rod casing assemblies of the intermediate drill rod units.

16. The tunneling apparatus of claim 1, wherein the first passage is connected to an external source of vacuum and is used to remove slurry during tunneling operations.

17. The tunneling apparatus of claim 1, wherein the first passage comprises an air channel, and wherein the second passage is connected to an external source of vacuum and is used to remove slurry during tunneling operations.

18. The tunneling apparatus of claim 1, wherein the first passage is configured to receive a steering control laser beam.

19. The tunneling apparatus of claim 1, wherein the tunneling apparatus is sized for use in installing pipe having a diameter less than 600 millimeters.

20. The tunneling apparatus of claim 1, wherein the drill rod casing assemblies include third passage defining structures that extend generally from the first ends to the second ends of the intermediate drill rod units, the third passage defining structures having open sides that face radially outwardly from the drill rod casing assemblies, the third passage defining structures being aligned with one another when the intermediate drill rod units are connected together such that the third passage defining structures define a continuous open-sided third passage that extends along an entire length of the string of intermediate drill rod units, wherein the open sides provide access to the continuous open-sided third passage from outside the outer boundaries of the shells, and wherein the first and second passages are fully enclosed within the drill rod casing assemblies.

21. The tunneling apparatus of claim 1, wherein the first passage conveys air down the hole being drilled, and wherein the second passage is used in a way selected from the group of ways consisting of: a) evacuating debris from a hole being drilled; b) carrying a control line used to control steering of the drill head; and c) conveying drilling fluid to the drill head.

22. A drill string comprising:

a plurality of intermediate drill rod units that can be connected together to form a string of intermediate drill rod units, each intermediate drill rod unit including a drive shaft rotatably mounted within a casing assembly including an outer shell that surrounds the drive shaft and defines a generally cylindrical outer boundary of each intermediate drill rod unit, each intermediate drill rod unit including a first end positioned opposite from a second end, the casing assemblies defining outer passages defining outwardly facing open sides that extend along entire lengths of the intermediate drill rod units, the outer passages being aligned with one another when the intermediate drill rod units are connected together such that the outer passages cooperate to define a continuous outer channel that extends along a length of the string of intermediate drill rod units, the drive shafts of the intermediate drill rod units being connected to one another when the intermediate drill rod units are connected together to allow torque to be transferred through the string of intermediate drill rod units, and the open sides of the outer passages providing access to the continuous outer channel from outside the cylindrical outer boundaries of the intermediate drill rod units;

wherein male and female torque transfer structures are provided at opposite ends of the drive shafts of the intermediate drill rod units, wherein the male and female torque transfer structures are respectively provided adjacent the first and second ends of the intermediate drill rod units, wherein the plurality of intermediate drill rod units include first and second intermediate drill rod units, and wherein when the first and second intermediate drill rod units are interconnected the female torque transfer structure of the first intermediate drill rod unit receives the male torque transfer structure of the second intermediate drill rod unit such that torque can be transferred between the drive shafts of the interconnected first and second intermediate drill rod units;

wherein each casing assembly defines first and second separate internal passages that extend through the entire length of the respective intermediate drill rod unit, the first and second separate passages being positioned between the drive shaft and the outer shell of the respective intermediate drill rod unit;

wherein the first internal passages of the intermediate drill rod units align with one another when the intermediate drill rod units are connected together such that the first internal passages cooperate to define a continuous first internal channel that extends along the length of the string of intermediate drill rod units; and wherein the second internal passages of the intermediate drill rod units align with one another when the intermediate drill rod units are connected together such that the second internal passages cooperate to define a continuous second internal channel that extends along the length of the string of intermediate drill rod units.

23. The drill string of claim 22, wherein the drill rod casing assemblies of the intermediate drill rod units include end plates positioned at the first and second ends of each of the intermediate drill rod units, and wherein the end plates have outer end faces defining first openings corresponding to the first internal passages, second openings corresponding to the second internal passages and notches corresponding to the outer passages.

24. The drill string of claim 23, wherein the drive shafts are rotationally supported within the end plates.

25. The drill string of claim 23, wherein seals are provided at the end faces of at least some of the end plates, the seals at least partially surrounding the first openings.

26. The drill string of claim 23, wherein the intermediate drill rod units include latches for latching the intermediate drill rod units together.

27. The drill string of claim 26, wherein the end plates include first and second end plates respectively positioned at the first and second ends of the intermediate drill rod units, wherein latching pins are secured to the first end plates and project outwardly from the outer end faces of the first end plates in a direction generally parallel to the drive shafts of the intermediate drill rod units, wherein the second end plates define latching pin receiving openings that extend through the second end plates from the outer end faces of the second end plates to inner end faces of the second end plates, and wherein the latches are mounted at locations inward with respect to the inner end faces of the second end plates.

28. The drill string of claim 27, wherein the latches are movably mounted at the inner end faces of the second end plates.

29. A tunneling apparatus comprising:

a plurality of intermediate drill rod units that can be connected together to form a string of intermediate drill rod units and that can be disconnected from one another to disassemble the string of intermediate drill rod units , each intermediate drill rod unit having a center axis, each intermediate drill rod unit also including a drill rod drive shaft co-axially aligned along the center axis and rotatably mounted within a drill rod casing assembly, the drill rod casing assemblies each defining axially extending first and second bores having axes that are offset from the center axes of the intermediate drill rod units, the first bores being co-axially aligned with one another when the intermediate drill rod units are connected together such that the first bores cooperate to define a continuous first passage that extends along a length of the string of intermediate drill rod units, the second bores being co-axially aligned with one another when the intermediate drill rod units are connected together such that the second bores cooperate to define a continuous second passage that extends along a length of the string of intermediate drill rod units, the drill rod casing assemblies each including an outer shell defining an outer boundary of each of the intermediate drill rod units, the first and second bores being positioned between the outer boundaries and the drill rod drive shafts of the intermediate drill rod units, and the drill rod drive shafts of the intermediate drill rod units being connected to one another when the intermediate drill rod units are connected together to allow torque to be transferred through the string of intermediate drill rod units;

a drill head unit including a distal end positioned opposite from a proximal end, the drill head unit including a drill head drive shaft that extends from the proximal end to the distal end of the drill head unit, the drill head drive shaft being rotatably mounted in a drill head casing assembly of the drill head unit, and the drill head unit including a cutting unit positioned at the distal end of the drill head unit; and an external drive for applying torque to the string of intermediate drill rod units that is transferred to the cutting unit of the drill head unit by the drill rod drive shafts and the drill head drive shaft to cause rotation of the cutting unit, and wherein the external drive also applies thrust to the string of intermediate drill rod units.

* * * * *

UNITED STATES PATENT AND TRADEMARK OFFICE

CERTIFICATE OF CORRECTION

PATENT NO. : 7,845,432 B2
APPLICATION NO. : 12/335193
DATED : December 7, 2010
INVENTOR(S) : Salins et al.

It is certified that error appears in the above-identified patent and that said Letters Patent is hereby corrected as shown below:

In the Specification

Col. 7, line 19: "which IS" should read --which is--

Signed and Sealed this
Tenth Day of June, 2014

Michelle K. Lee

Michelle K. Lee
*Deputy Director of the United States Patent and Trademark Office*